US011350805B2

(12) United States Patent
Kim et al.

(10) Patent No.: US 11,350,805 B2
(45) Date of Patent: Jun. 7, 2022

(54) WINDOW CLEANING TOOL

(71) Applicants: Jong Myong Kim, Uiwang-si (KR); Yoon Tae Kim, Gapyeong-gun (KR)

(72) Inventors: Jong Myong Kim, Uiwang-si (KR); Yoon Tae Kim, Gapyeong-gun (KR)

( * ) Notice: Subject to any disclaimer, the term of this patent is extended or adjusted under 35 U.S.C. 154(b) by 0 days.

(21) Appl. No.: 17/084,806

(22) Filed: Oct. 30, 2020

(65) Prior Publication Data

US 2021/0127913 A1 May 6, 2021

(30) Foreign Application Priority Data

Nov. 4, 2019 (KR) ..... 10-2019-0139401
Oct. 14, 2020 (KR) ..... 10-2020-0132723

(51) Int. Cl.
*A47L 1/15* (2006.01)
*A47L 1/12* (2006.01)
*A47L 1/03* (2006.01)

(52) U.S. Cl.
CPC *A47L 1/15* (2013.01); *A47L 1/12* (2013.01); *A47L 1/03* (2013.01)

(58) Field of Classification Search
CPC ..... A47L 13/40; A47L 13/41; A47L 11/15; A47L 11/12; A47L 11/03; A01K 63/04; A01K 63/10
USPC ..... 15/103
See application file for complete search history.

(56) References Cited

FOREIGN PATENT DOCUMENTS

KR 101633011 B1 * 6/2016

OTHER PUBLICATIONS

Translation of KR101633011B1 retrieved from Espacenet on Jan. 7, 2022 (Year: 2016).*

* cited by examiner

*Primary Examiner* — Orlando E Aviles
*Assistant Examiner* — Thomas Raymond Rodgers
(74) *Attorney, Agent, or Firm* — Lex IP Meister, PLLC

(57) ABSTRACT

Proposed is to a window cleaning tool including an internal unit or including an internal unit and an external unit. The window cleaning tool is configured to prevent an external unit from separating and falling, and to realize smooth movement of a cleaner during washing because when an internal unit moves up, the front end of an internal unit blade rotates away from an inner surface of glass and the front end of an external unit blade rotates away from an outer surface of the glass, and when the internal unit moves down, the front ends of the internal unit blade and the external unit blade rotate toward the surfaces of the glass to be pressed.

10 Claims, 24 Drawing Sheets

WINDOW CLEANING TOOL

CROSS REFERENCE TO RELATED APPLICATION

The present application claims priority to Korean Patent Application No. 10-2019-0139401, filed Nov. 4, 2019, and Korean Patent Application No. 10-2020-0132723, filed Oct. 14, 2020, the entire contents of which is incorporated herein for all purposes by this reference.

BACKGROUND OF THE INVENTION

Field of the Invention

The present disclosure relates to a window cleaning tool including an internal unit or an internal unit and an external unit. In more detail, the present disclosure relates to a window cleaning tool that may be conveniently used, may prevent an external unit from separating and falling, and may enable smooth movement of a cleaner during washing because when an internal unit moves up, the front end of an internal unit blade rotates away from an inner surface of glass and the front end of an external unit blade rotates away from an outer surface of the glass, and when the internal unit moves down, the front ends of the internal unit blade and the external unit blade rotate toward the surfaces of the glass to be pressed.

Description of the Related Art

In order to clean windows, people remove dirt on the inner surface and the outer surface of glass using a sponge having a washing solution, etc., and if necessary, they remove water remaining on the glass with a rubber blade. Since it usually takes a long time to clean a window, a demand for a window cleaning tool that may quickly and conveniently clean a window has been increasing.

A magnetic window cleaner (hereafter, referred to as a cleaner) that includes an internal cleaning device (hereafter, referred to as an "internal unit") and an external cleaning device (hereafter, referred to as an "external unit"), which each have a built-in magnet and are configured to be attached to face each other with a window therebetween, and washes the inner surface and the outer surface by manually operating the internal unit such that the external unit coupled by a magnetic force follows the internal unit is generally used in order to clean the windows of high-story buildings such as an apartment that are difficult to reach. However, the method of operating the cleaner is complicated or, when a window is thick (e.g., a system window), the external unit separates from a glass surface and falls in many cases due to insufficient magnetism of the built-in magnet. However, when the magnetism is too strong relative to the thickness of glass, the internal unit and the external unit are strongly attached to the glass surface, so the cleaner cannot be smoothly moved. Further, when the external unit is moved, the friction on the glass surface increases, so the external unit cannot follow the internal unit, whereby the external unit separates and falls in many cases.

The present disclosure proposes a cleaner that a user may most easily use and may be smoothly moved without an external unit separating and falling.

The background described above was kept or obtained by the inventor(s) in the process of derive the invention and should not be considered as a well-known technology published before the filing of the present disclosure.

SUMMARY OF THE INVENTION

The present disclosure has been made in an effort to solve the problems and an objective of the present disclosure is to provide a window cleaning tool that may be conveniently used by a user and enables smooth movement of a cleaner without an external unit separating and falling during washing.

Another objective of the present disclosure is to provide a window cleaning tool that enable reduction of the number of parts and the weight of an entire external unit.

Another objective of the present disclosure is to provide a window cleaning tool that does not injure the body of a user and is not broken even though attraction of a magnet is strong when it is handled.

In order to achieve the objectives, a window cleaning tool according to an objective of the present disclosure includes an internal unit including: an internal unit housing; an internal unit blade holder disposed rotatably with respect to the internal unit housing; and an internal unit wiper having an internal unit blade fixed to the internal unit blade holder and protruding toward an inner surface of glass, in which when the internal unit moves up, a front end of the internal unit blade rotates away from the inner surface of the glass, and when the internal unit moves down, the front end of the internal unit blade rotates toward the surface of the glass to be pressed.

The internal unit may further include a total of two internal unit magnet assemblies respectively disposed at both sides of the internal unit housing.

In order to achieve the objectives of the present disclosure, a window cleaning tool includes: an internal unit including an internal unit housing, an internal unit blade holder disposed rotatably with respect to the internal unit housing, an internal unit wiper having an internal unit blade fixed to the internal unit blade holder and protruding toward an inner surface of glass, and a total of two internal unit magnet assemblies respectively disposed at both sides of the internal unit housing; and an external unit including an external housing, an external unit blade holder disposed rotatably with respect to the external unit housing, an external unit wiper having an external unit blade fixed to the external unit blade holder and protruding toward an outer surface of glass, and a total of two external unit magnet assemblies respectively disposed at both sides of the external unit housing and applying attraction between the internal unit magnetic assemblies and the external unit magnetic assemblies, in which when the internal unit moves up, a front end of the internal unit blade rotates away from the inner surface of the glass and a front end of the external unit blade rotates away from an outer surface of the glass, and when the internal unit moves down, the front ends of the internal unit blade and the external unit blade rotate toward the surface of the glass to be pressed.

The external unit may further include: an external unit holder link pulling the external unit blade holder such that the front end of the external unit blade is spaced from the outer surface of the glass when the internal unit moves up and the external unit magnetic assemblies are slid up by attraction of the internal unit magnetic assemblies, and pushing the external unit blade holder such that the front end of the external unit blade is pressed to the outer surface of the glass when the internal unit moves down and the external unit magnetic assemblies are slid down by attraction of the internal unit magnetic assemblies; and external unit pivot levers each having both ends respectively connected to the external unit magnetic assembly and the external unit holder link, having a portion, which is rotatably connected to the external unit housing by a pivot shaft, between the both ends, pulling the external unit holder link when the external unit magnetic assemblies move up, and pushing the external unit holder link when the external unit magnetic assemblies move down.

The external unit may further include: a washing pad plate moving with the external unit holder link through a connection joint, being able to slide in parallel with the external unit housing, and having slope grooves coming in contact with slope protrusions formed on the external unit housing; and an external unit washing pad disposed on the washing pad plate to clean the outer surface of the glass, the slope protrusions may move the washing pad plate toward the outer surface of the glass by pushing the washing pad plate away from the external unit housing in accordance with a sliding distance of the washing pad plate, when the internal unit moves up, the washing pad plate moves away from the outer surface of the glass and friction between the external unit washing pad and the outer surface of the glass decreases, and when the internal unit moves sown, the washing pad plate moves toward the outer surface of the glass and the external unit washing pad is pressed to the outer surface of the glass.

Thee external unit may further include an external unit elastic member connected between the external unit housing and the external unit holder link, providing elasticity pressing the front end of the external unit blade to the outer surface of the glass, and helping downward movement of the external unit magnetic assemblies with respect to the external unit housing.

The external unit magnetic assemblies each may include: a magnet generating attraction between the internal unit magnetic assembly and the magnet; a casing accommodating the magnet; and guide rollers disposed on both sides of the casing, and the external unit housing may include guide rails providing paths enabling the guide rollers to roll.

The external unit magnetic assemblies each may include: a magnet generating attraction between the internal unit magnetic assembly and the magnet; a casing accommodating the magnet; upper guide rollers disposed on both sides of the casing; and lower guide rollers formed at lower corners of the casing and coming in contact with the glass, and the external unit housing may include guide rails providing paths enabling the upper guide rollers to roll and inclined up and down.

The external unit housing may further include rectangular guide rail housings in which the inclined guide rails are formed on both sides facing each other at a lower portion.

A total of four upper guide rollers may be formed at ends of both facing sides of the casing, and two guide rails may be inclined up and down and formed up and down on each of both sides facing each other at a lower portion in the rectangular guide rail housing.

The inclination of the guide rails may decrease as it goes up.

Four lower guide rollers may protrude outward at the lower corners of the casing.

The internal unit may further include: a handle that a user may hold; an internal unit holder link pushing or pulling an end of the internal blade holder such that the front end of the internal unit blade is pressed to the inner surface of the glass or is spaced from the inner surface of the glass; and an internal unit pivot lever having a pivot shaft rotatably connected to the internal unit housing, a handle shaft rotatably connected to the handle, and a link shaft rotatably connected to the internal holder link.

The internal unit may further include an internal unit elastic member connected between the internal unit housing and the internal unit pivot lever, providing elasticity pressing the front end of the internal unit blade to the inner surface of the glass, and helping downward movement of the handle with respect to the internal unit housing.

The internal unit may further include a plurality of safety plates protruding toward a rear surface of the external unit from the internal unit housing at a side or both sides of the internal unit magnetic assemblies.

The internal unit may further include: a plurality of safety plate guide holes elongated up and down in the internal housing to guide the safety plate forward and rearward; and a plurality of torsion springs disposed over the safety plate guide holes and applying a force protruding the safety plate toward the rear surface of the external unit.

The internal unit may further include a stopper lever mechanism configured to rotate up and down to prevent and enable rearward protrusion of the safety plates, and the stopper lever mechanism may include: stoppers formed to be able to move up and down under the safety plate guide holes and preventing and enabling rearward protrusion of the safety plates; a pair of left and right symmetric stopper levers each having a first end connected to the stoppers, disposed on the internal unit housing to be rotatable by lever shafts, and being able to move up and down such that the stoppers prevent and enable rearward protrusion of the safety plates; a stopper knob for gripping disposed between the stopper levers to transmit up and down rotational force of the stopper levers; and a stopper knob elastic member elastically supporting the stopper knob for gripping.

According to the window cleaning tool of the present disclosure, it is possible to quickly and conveniently clean the inner surface and the outer surface of glass.

Further, when the internal unit moves up, the internal unit wiper blade of the internal unit is spaced from the surface of glass, the external unit wiper blade of the external unit is spaced from the surface of the glass, and the friction between the washing pad and the surface of the glass decreases, so the external unit smoothly follows the internal unit. Accordingly, the possibility of the external unit separating and falling when the cleaner is moved up decreases and the cleaner may be smoothly moved.

Further, when the internal unit moves down, the internal unit wiper blade of the internal unit comes in contact with the surface of glass, the external unit wiper blade of the external unit comes in contact with the surface of the glass, and the washing pad is pressed to the surface of the glass, so it is possible to simultaneously remove dirt and water.

Further, it is possible to reduce the number of parts of the external unit and the weight of the entire external unit.

Further, since the safety plates are installed on the internal unit, even if the internal unit and the external unit stick to each other when the window cleaning unit is handled or due to carelessness, it is possible to prevent injuries to the user's body or breakdown of the cleaning tool.

BRIEF DESCRIPTION OF THE DRAWINGS

The above and other objectives, features and other advantages of the present disclosure will be more clearly understood from the following detailed description when taken in conjunction with the accompanying drawings, in which.

DETAILED DESCRIPTION OF THE INVENTION

Exemplary embodiments of the present disclosure will be described in detail hereafter with reference to the accompanying drawings in order for those skilled in the art to be able to easily accomplish the gist of the present disclosure.

Figure 1A:
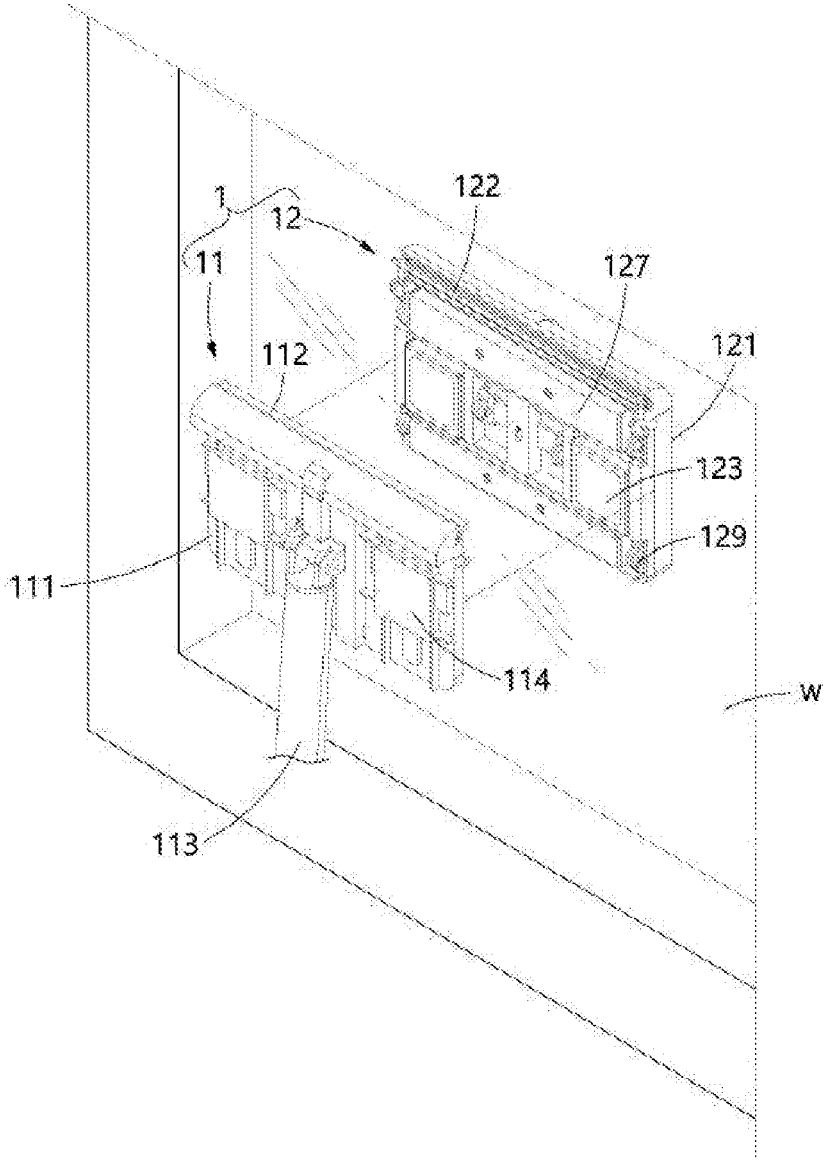
FIG. 1A is a perspective view of a window cleaning tool according to an embodiment of the present disclosure.
Figure 1B:
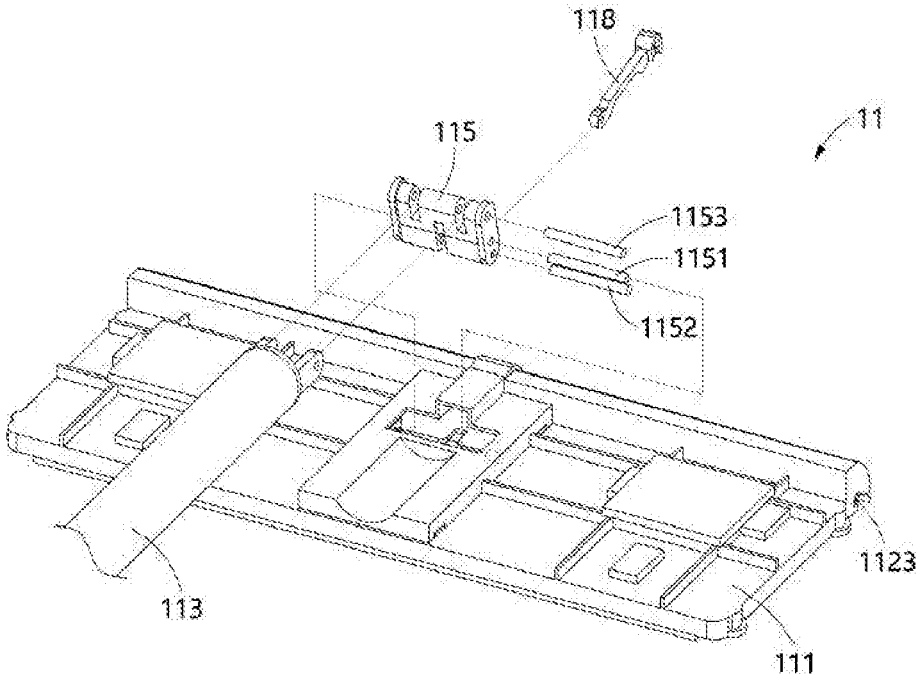
FIG. 1B is an exploded perspective view of some parts of an internal unit according to an embodiment of the present disclosure.
Figure 2:
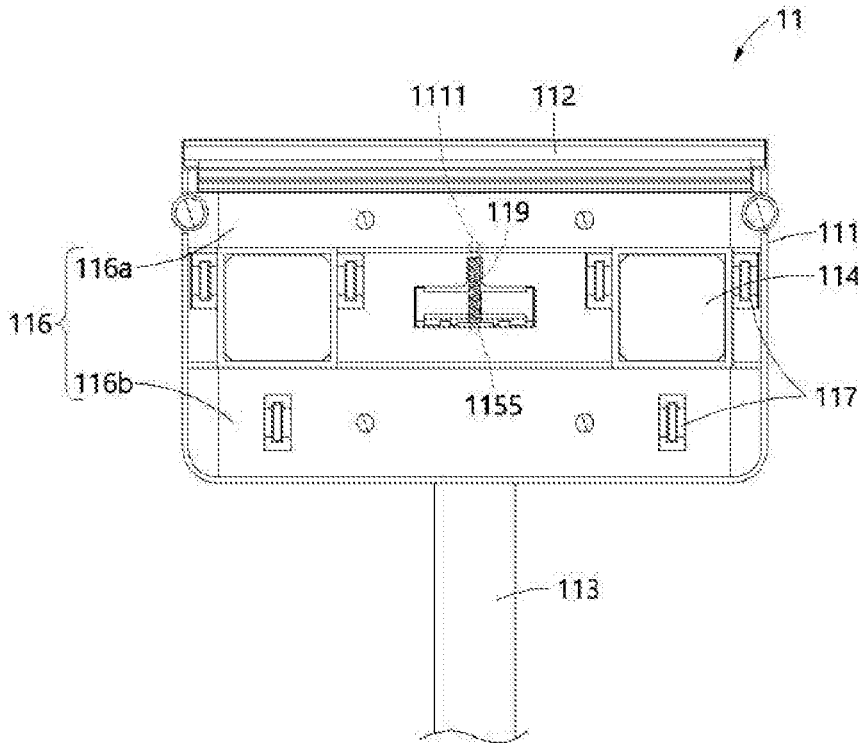
FIG. 2 is a front view of the internal unit according to an embodiment of the present disclosure.
Figure 3:
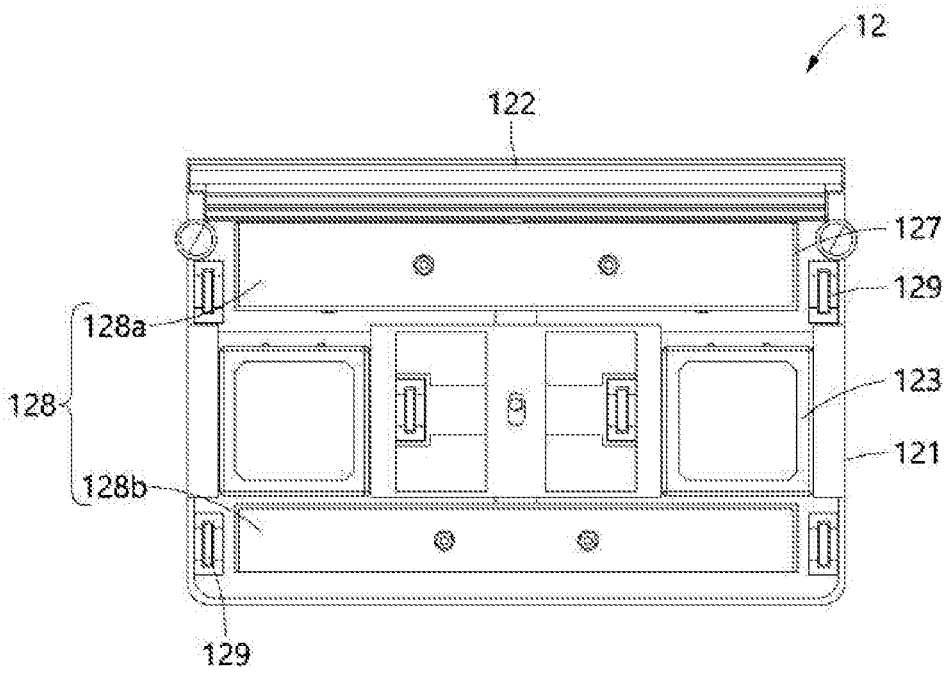
FIG. 3 is a front view of an external unit according to an embodiment of the present disclosure.
Figure 4A:
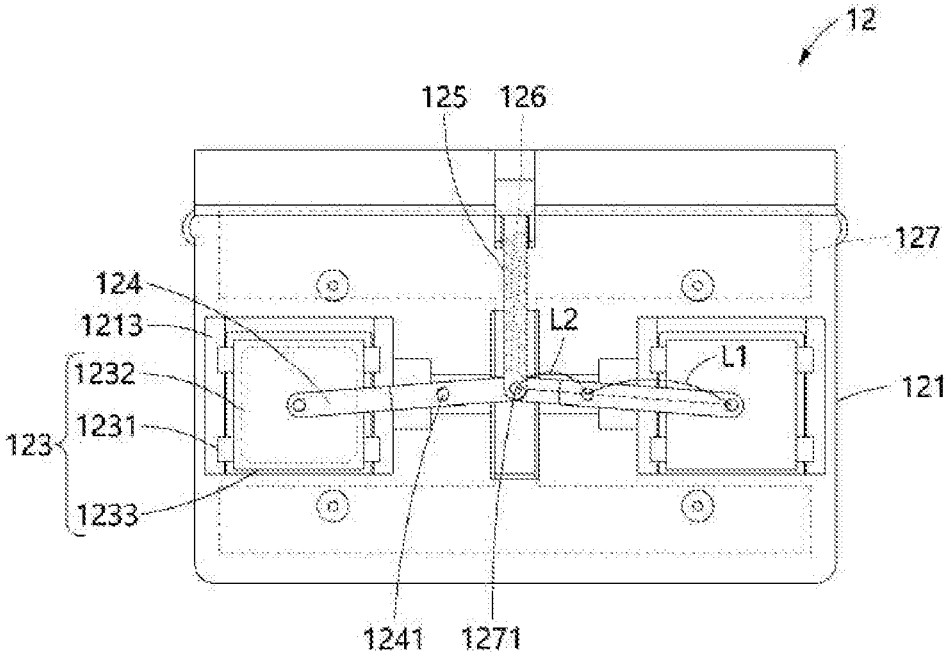
FIG. 4A is a rear view of the external unit according to an embodiment of the present disclosure.
Figure 4B:
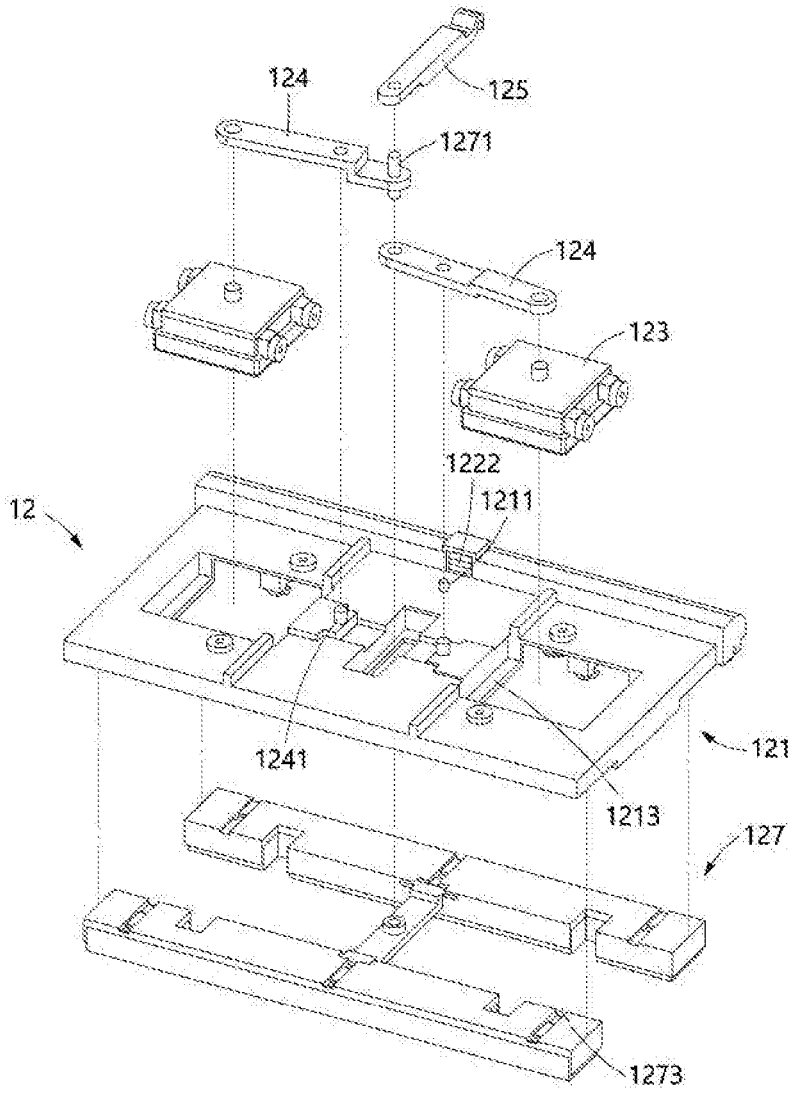
FIG. 4B is an exploded perspective view of some parts of the external unit according to an embodiment of the present disclosure.
Figure 5:
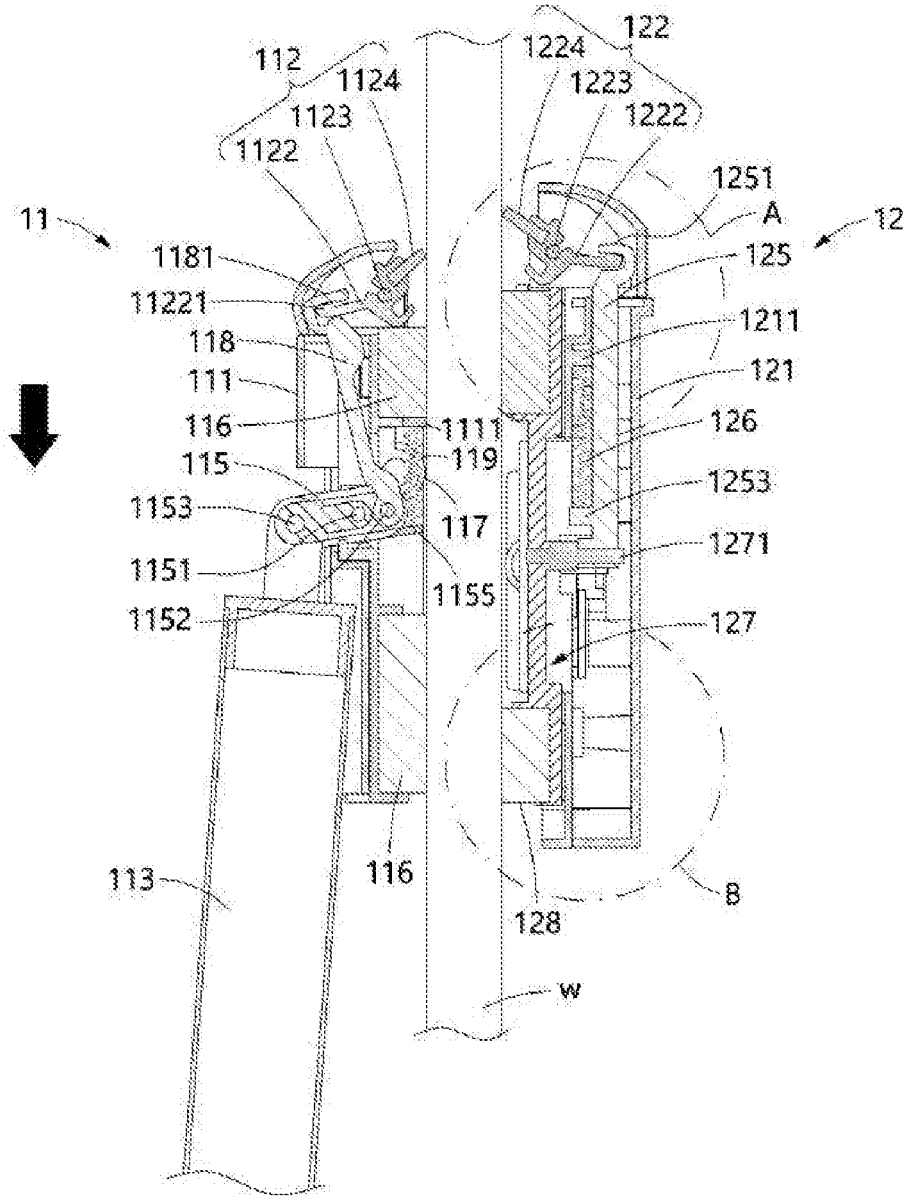
FIG. 5 is a lateral cross-sectional view when the window cleaning tool according to an embodiment of the present disclosure is moved down on a window.

FIG. 1A is a perspective view of a window cleaning tool according to an embodiment, FIG. 1B is an exploded perspective view of some parts of an internal unit according to an embodiment, FIG. 2 is a front view of the internal unit according to an embodiment, FIG. 3 is a front view of an external unit according to an embodiment, FIG. 4A is a rear view of the external unit according to an embodiment, FIG. 4B is an exploded perspective view of some parts of the external unit according to an embodiment, and FIG. 5 is a lateral cross-sectional view of the window cleaning tool according to an embodiment.

Referring to FIGS. 1A to 5, a window cleaning tool 1 according to an embodiment is attached to both sides of glass w by magnetism, so it may simultaneously clean both sides of the glass w.

For example, the window cleaning tool 1 according to an embodiment may include an internal unit 11 configured to be installed on the side positioned inside a building of both sides of the glass w and an external unit 12 configured to be installed on the opposite side of the glass w.

For example, as shown in the figures, the internal unit 11 may be manually moved by a user in contact with the inner surface of the glass w. However, it should be noted that the internal unit 11 may automatically clean the window using a power source disposed therein. Although the case in which the internal unit 11 is a manual type is exemplified hereafter, those skilled in the art may understand that the external unit 12 having the same structure may be applied to both of a manual internal unit and an automatic internal unit.

The internal unit 11 according to an embodiment may include an internal unit housing 111, an internal unit wiper 112, a handle 113, internal unit magnet assemblies 114, an internal unit pivot lever 115, an internal unit holder link 118, an internal unit washing pad 116, an internal unit elastic member 119, and internal unit wheels 117.

The internal unit housing 111 may support various parts of the internal unit 11. For example, in the internal unit housing 111, the surface and the direction that are disposed to face glass w may be defined as the front surface and the front direction, and the opposite surface and direction ay be defined as the rear surface and the rear direction. The internal unit housing 111 may include a first internal unit elastic member retainer 1111 that fixes a side of the internal unit elastic member 119.

The internal unit wiper 112 is disposed at the top of the internal unit 11 and may remove water or a washing solution remaining on the surface of the glass w.

For example, the internal unit wiper 112 may include a blade 1124 protruding to come in contact with the inner surface of the glass w, a blade holder 1122 fixing the blade 1124, and a holder shaft 1123 coupling the blade holder 1122 such that the blade holder 1122 can rotate with respect to the internal unit housing 111.

The blade holder 1122 may be rotated with respect to the internal unit housing 111 by the holder shaft 1123 while supporting the blade 1124.

For example, the blade holder 1122 may be connected to the internal unit holder link 118 and may be rotated about the holder shaft 1123 by movement of the internal unit holder link 118.

For example, a first end of the blade holder 1122 may support the blade 1124 protruding toward the surface of the glass w and a second end of the blade holder 1122 may be held by the internal unit holder link 118.

For example, the blade holder 1122 may have a holding portion 11221 held by the internal unit holder link 118.

The blade 1124 may be disposed on the blade holder 1122 and may protrude toward the surface of the glass w. The blade 1124 can remove water or a washing solution existing on the surface of the glass w. For example, the blade 1124 may be made of a material having elasticity and high friction such as urethane or rubber.

For example, the blade 1124 may be a member laterally extending and may be coupled in parallel with the blade holder 1122 in the extension direction.

The holder shaft 1123 may connect the internal unit wiper 112 such that the internal unit wiper 112 may rotate with respect to the internal unit housing 111. For example, the holder shaft 1123 may be integrally coupled to left and right sides of the internal unit housing 111, but may be formed in any type as long as it can connect the blade holder 1122 such that the blade holder 1122 can rotate with respect to the internal unit housing 111.

The handle 113 is a rod-shaped member extending with a first end rotatably coupled to the rear surface of the internal unit 11 and a user may hold the handle 113.

For example, the handle 113 may be rotatably connected to a first end of the internal unit pivot lever 115. Alternatively, the handle 113 may be rotatably connected directly to the internal unit holder link 118. For example, the rotational axis of the handle 113 may be parallel with the holder shaft 1123.

One internal unit magnet assembly 114 may be disposed at each of the left and right sides of the center of the internal unit housing 111. According to this structure, it is possible to more stably clean the glass w even with the same number of magnets, as compared with when magnets are disposed at the center of the internal unit housing 111.

The internal unit pivot lever 115 may include a pivot shaft 1151 rotatably connected to the internal unit housing 111, a handle shaft 1153 rotatably connected to the handle 113, a link shaft 1152 rotatably connected to the internal unit holder link 118, and a second internal unit elastic member retainer 1155 fixing a second end of the internal unit elastic member 119 having a first end fixed to the first internal unit elastic member retainer 1111.

The handle shaft 1153 and the link shaft 1152 may be disposed opposite to each other with the pivot shaft 1151 therebetween. According to this structure, when the handle 113 is pushed up, the internal unit pivot lever 115 may pull down the internal unit holder link 118 while rotating in one direction about the pivot shaft 1151. On the contrary, when the handle 113 is pushed down, the internal unit pivot lever 115 may push up the internal unit holder link 118 while rotating in the other direction about the pivot shaft 1151.

For example, the rotary shaft connecting the internal unit pivot lever 115 to the internal unit housing 111, the handle 113, and the internal unit holder link 118 may be parallel with the holder shaft 1123.

A first end of the internal unit holder link 118 may be rotatably connected to the internal unit pivot lever 115 and a second end thereof may rotatably hold a first end of the blade holder 1122. A ring-shaped connecting portion 1181 that may rotatably hold the blade holder 1122 may be formed at the second end of the internal unit holder link 118.

According to this structure, when a user hold the handle 113 and applies a force for moving up or down the internal unit 11 on the glass w, the force and torque applied to the handle 113 may be transmitted as a force that moves or rotates the internal unit pivot lever 115 and the internal unit holder link 118, thereby being able to rotate the blade holder 1122. Accordingly, it is possible to attach or detach the front end of the blade 1124 to or from a glass surface.

The internal unit washing pad 116 may remove dirt by supplying a washing solution to the glass w in contact with the glass w. For example, the internal unit washing pad 116 may absorb a washing solution flowing down on a window after collecting at the front end of the blade 1124 and may prevent secondary contamination due to a washing solution falling to the ground when the blade 1124 wipes off a washing solution on the glass surface. The internal unit washing pad 116, for example, may be made of sponge, etc. It should be noted that the internal unit washing pad 116 may be made of any material that may absorb a washing solution such as soapy water and the kind of the internal unit washing pad 116 is not limited. For example, the internal unit washing pad 116 may be detachably fitted in a groove formed on the front surface of the internal unit 11.

For example, the internal unit washing pad 116, as shown in FIG. 2, may be disposed under the blade 1124. For example, the internal unit washing pad 116 may have a laterally elongated shape.

For example, a plurality of internal unit washing pads 116 may be provided and disposed at a plurality of positions on the front surface of the internal unit 11 and may include two internal unit washing pads 116*a* and 116*b* parallel with each other and spaced up and down apart from each other.

According to this structure, when a user moves down the cleaning tool on a window, the internal unit washing pad 116 and the blade 1124 sequentially come in contact with a specific portion of the glass w. Accordingly, the user may perform both of washing a window and removing water through only one step.

The internal unit elastic member 119 generates tension between the internal unit housing 111 and the internal unit pivot lever 115 so that the handle 113 moves down earlier than the internal unit housing 111 when the internal unit 11 is moved down, whereby the blade 1124 of the internal unit 11 may move down with the internal unit housing 111 in contact with a glass surface. That is, the internal unit elastic member 119 may provide torque for rotating the blade holder 1122 in one direction such that the front end of the blade 1124 comes in contact with the surface of the glass w.

For example, a first end of the internal unit elastic member 119 may be fixed to the first internal unit elastic member retainer 1111 of the internal unit housing 111 and a second end thereof may be fixed to the second internal unit elastic member retainer 1155 of the internal unit pivot lever 115. For example, the first internal unit elastic member retainer 1111 may be positioned over the second internal unit elastic member retainer 1155.

The internal unit wheels 117 may enable the cleaning tool to be smoothly moved and may maintain the pressure applied to a window from the front end of the blade 1124 at a predetermined level when a user cleans the window w. A plurality of internal unit wheels 117 may be disposed on the front surface of the internal unit housing 111 and may protrude a predetermined height from the front surface of the internal unit housing 111. A plurality of internal unit wheels 117 may be disposed in the longitudinal direction and/or width direction of the internal unit housing 111, thereby being able to maintain the blade 1124 at a predetermined angle with respect to the glass w when the blade 1124 slide down on the glass w.

The external unit 12 may follow the internal unit by magnetism in contact with the outer surface of the glass w, but the internal unit 11 according to the present disclosure may be independently used without the external unit 12.

The external unit 12 according to an embodiment may include an external unit housing 121, an external unit wiper 122, external unit magnet assemblies 123, external unit pivot levers 124, an external unit holder link 125, a washing pad plate 127, an external unit washing pad 128, an external unit elastic member 126, and external unit wheels 129.

The external unit housing 121 may support various parts of the external unit 12. For example, in the external unit housing 121, the surface and the direction that are disposed to face glass w may be defined as the front surface and the front direction, and the opposite surface and direction ay be defined as the rear surface and the rear direction.

For example, the external unit housing 121 may include a first external unit elastic member retainer 1211 fixing an end of the external unit elastic member 126 and slope protrusions 1212 (see FIGS. 6 and 7) protruding from the surface facing the washing pad plate 127.

The external unit wiper 122 is disposed at the top of the external unit 12 and may remove water or a washing solution remaining on the surface of the glass w.

For example, the external unit wiper 122 may include a blade 1224 protruding to come in contact with the outer surface of the glass w, a blade holder 1222 fixing the blade 1224, and a holder shaft 1223 coupling the blade holder 1222 such that the blade holder 1222 may rotate with respect to the external unit housing 121.

The blade holder 1222 may be rotatably connected to the external unit housing 121 by the holder shaft 1223 while supporting the blade 1224. For example, the blade holder 1222 may have a laterally extending shape.

For example, the blade holder 1222 may be connected to the external unit holder link 125 and may be rotated about the holder shaft 1223 by movement of the internal unit holder link 125.

For example, a first end of the blade holder 1222 may support the blade 1224 protruding toward the surface of the glass w and a second end of the blade holder 1222 may be retained by the external unit holder link 125.

For example, the blade holder 1222 may have a holding portion 12221 (see FIG. 6) held by the external unit holder link 125.

The blade 1224 may be disposed on the blade holder 1222 and may protrude toward the surface of the glass w. The blade 1224 may remove water or a washing solution existing on the surface of the glass w. For example, the blade 1224 may be made of a material having elasticity and high friction such as urethane or rubber.

For example, the blade 1224 may be a member laterally extending and may be coupled in parallel with the blade holder 1222 in the extension direction.

The holder shaft 1223 may connect the external unit wiper 122 such that the external unit wiper 122 can rotate with respect to the external unit housing 121. For example, the holder shaft 1223 may be integrally coupled to left and right sides of the external unit housing 121, but may be formed in any type as long as it can connect the blade holder 1222 such that the blade holder 1122 can rotate with respect to the external unit housing 121.

The external unit magnet assemblies 123 may include a magnet disposed in the external unit housing 121. The external unit magnet assemblies 123 generate an attraction in cooperation with the internal unit magnet assemblies 114 of the internal unit 11, thereby being able to keep the front surfaces of the internal unit 11 and the external unit 12 being pressed to both sides of the glass w and being able to enable the external unit 12 to follow the internal unit 11 even though the internal unit 11 moves.

For example, the external unit magnet assemblies 123 may be installed to slide up and down with respect to the external unit housing 121.

For example, the external unit magnet assemblies 123 each may include a casing 1233, a magnet 1232 disposed in the casing 1233, and guide rollers 1231.

The guide rollers 1231 may help movement of the external unit magnet assemblies 123 by rolling upward along guide rails 1213 formed on the external unit housing 121. For example, the guide rollers 1231 may be disposed on the left and right sides of the casing 1233. The guide rollers 1231 remarkably reduce the friction between the external unit housing 121 and the external unit magnet assemblies 123, so the external unit magnet assemblies 123 may quickly follow movement of the internal unit magnet assemblies 114. Accordingly, the external unit magnet assemblies 123 may quickly and smoothly move earlier than the external unit housing 121, so the state of the external unit 12 can be quickly changed.

The external unit pivot levers 124 are rotatably disposed on the external unit housing 121 by a pivot shaft 1241. A first end of the external unit pivot lever 124 may be rotatably connected to a shaft disposed on the external unit magnet assembly 123 and a second end thereof may be rotatably connected to the external unit holder link 125 through a connection joint 1271.

The external unit magnet assembly 123 and the connection joint 1271 may be disposed opposite to each other with the pivot shaft 1241 therebetween. According to this structure, the external unit holder link 125 may be moved in the opposite direction of the movement direction of the external unit magnet assembly 123. In detail, when the external unit magnet assembly 123 is moved up, the external unit pivot lever 124 may pull down the external unit holder link 125 while rotating in one direction about the pivot shaft 1241. On the contrary, when the external unit magnet assembly 123 is moved down, the external unit pivot lever 124 may push up the external unit holder link 125 while rotating in the other direction about the pivot shaft 1241.

As shown in FIG. 4A, the distance L1 from the pivot shaft 1241 to the portion connected to the external unit magnet assembly 123 may be larger than the distance L2 from the pivot shaft 1241 to the connection joint 1271. For example, L1 may be 1~3 times L2. According to this relationship, the up-down force generated by movement of the external unit magnet assemblies may be amplified by the principle of leverage and transmitted to the external unit holder link 125, so reliability of the operation described above may be secured.

For example, the external unit pivot levers 124 may be rotatably connected to the washing pad plate 127 through an additional connection joint 1271.

For example, the external unit pivot levers 124 may be two lever members connecting the external unit holder link 125 to the external unit magnet assemblies 123 because two external unit magnet assemblies 123 are provided, as shown in FIG. 4A.

For example, the external unit pivot levers 124 are disposed to be able to pivot on a specific point (e.g., a point between the external unit magnet assemblies 123 and the connection joint 1271) on the external unit housing 121, in which a first end may be rotatably connected to the external unit magnet assemblies 123 and a second end may be rotatably connected to the external unit holder link 125 and/or the washing pad plate 127.

According to this structure, when the external unit magnet assemblies 123 slide up and down with respect to the external unit housing 121, the posture of the external unit pivot levers 124 may change, whereby the positions of the external unit holder link 125 and/or the washing pad plate 127 connected to the external unit pivot levers 124 may also change. For example, the external unit holder link 125 and/or the washing pad plate 127 may move in the opposite direction to movement of the external unit magnet assemblies 123 with respect to the external unit housing 121.

A first end of the external unit holder link 125 may be rotatably connected to the external unit pivot levers 124 and a second end thereof may rotatably hold a first end of the blade holder 1222.

For example, the first end of the external unit holder link 125 may be connected to the connection joint 1271 of the washing pad plate 127.

For example, the external unit holder link 125 may have the connection joint 1271 rotatably connected to the external unit pivot levers 124, a connecting portion 1251 rotatably holding the blade holder 1222, and a second external unit elastic member retainer 1253 fixing a second end of the external unit elastic member 126 having a first end fixed to the first external unit elastic member retainer 122.

For example, as shown in FIG. 4A, when there are on external unit holder link 125 and two external unit pivot levers 124, the external unit holder link 125 may be connected to be able to simultaneously rotate with the two external unit pivot levers 124.

For example, the connecting portion 1251 may have a ring shape that may hold the first end of the blade holder 1222.

According to this structure, when a force moving up or down the external unit magnet assemblies 123 with respect to the external unit housing 121 is applied, the force of the external unit magnet assemblies 123 moving up and down may be converted into a force moving or rotating the external unit holder link 125 and the washing pad plate 127 through the external unit pivot levers 124.

The washing pad plate 127 may support an external unit washing pad 128 on the front surface of the external unit housing 121 and may be disposed to be able to slide up and down with respect to the external unit housing 121.

The washing pad plate 17 may be rotatably connected to the external unit pivot levers 124 and may slide up and down with rotation of the external unit pivot levers 124. For example, the washing pad plate 127 may slide in the opposite direction to the sliding direction of the external unit magnet assemblies 123.

For example, the forward gap between the washing pad plate 127 and the surface of the glass w may be adjusted in accordance with the sliding position. For example, the washing pad plate 127 may have slope grooves 1273 (see FIGS. 6 and 7) formed on the surface facing the external unit housing 121.

The slope grooves 1273 may accommodate the slope protrusions 1212 formed on the external unit housing 121 when the washing pad plate 127 slides.

According to this structure, the washing pad plate 127 may protrude toward the glass w under interference with the slope protrusions 1212 in accordance with the relative up-down gap between the slope protrusions 1212 and the slope groove 1273.

In detail, when the washing pad plate 127 slides over the slope protrusions 1212, the washing pad plate 127 is interfered with by the slope protrusions 1212 protruding from the external unit housing 121, whereby the internal unit washing pad 116 may be pressed to the glass surface. On the contrary, when the washing pad plate 127 slides and the slope protrusions 1212 are inserted into the slope grooves 1273, the washing pad plate 127 is not interfered with by the slope protrusions 1212, whereby the pressure applied to the glass surface by the internal washing pad 116 may be decreased or the internal washing pad 116 may be spaced from the glass surface.

For example, any one or more of the slope grooves 1273 and the slope protrusions 1212 may have a shape, which is inclined in the sliding direction of the washing pad plate 127, at the contact portions. Accordingly, when the washing pad plate 127 slides, the slope protrusion 1212 may be smoothly inserted into or separated out of the slope grooves 1273 and the distance that the washing pad plate 127 protrudes from the external unit housing 121 may be gradually adjusted in accordance with the relative positions of the washing pad plate 127 and the external unit housing 121.

The external unit washing pad 128 may supply a washing solution to the glass w and remove dirt on the glass surface in contact with the glass w. For example, the external unit washing pad 128 may be disposed on the front surface of the washing pad plate 127.

For example, the external unit washing pad 128 may absorb a washing solution flowing down on a window after collecting at the front end of the blade 1224 and may prevent secondary contamination due to a washing solution falling to the ground when the blade 1224 wipes off a washing solution on the glass surface. The external unit washing pad 128, for example, may be made of sponge, etc. It should be noted that the external unit washing pad 128 may be made of any material that may absorb a washing solution such as soapy water and the kind of the external unit washing pad 128 is not limited. For example, the external unit washing pad 128 may be detachably fitted in a groove formed on the front surface of the washing pad plate 127.

For example, the external unit washing pad 128 may be disposed under the blade 1224. For example, the external unit washing pad 128 may have a laterally elongated shape.

For example, a plurality of external unit washing pads 128 may be provided and disposed at a plurality of positions on the front surface of the washing pad plate 127 and, for example, as shown in FIG. 3, may include two external unit washing pads 128*a* and 128*b* parallel with each other and spaced up and down apart from each other.

For example, the external unit washing pad 128 may selectively slightly come in contact with the surface of the glass w or may be strongly pressed to the surface of the glass when the washing pad plate 127 slides.

The external unit elastic member 126 may increase the force moving down the external unit magnet assemblies 123 with respect to the external unit housing 121. The external unit elastic member 126 generates tension between the external unit housing 121 and the holder link 125 such that when the internal unit moves down, the magnet assemblies of the external unit moves down earlier than housing, whereby the blade of the external unit and the washing pad may move together with the housing after coming in contact with the glass surface. That is, the external unit elastic member 126 may provide torque for rotating the blade holder 1122 in one direction such that the front end of the blade 1124 comes in contact with the surface of the glass w.

For example, a first end of the external unit elastic member 126 may be fixed to the first external unit elastic member retainer 1211 of the external unit housing 121 and a second end thereof may be fixed to the second external unit elastic member retainer 1253 of the holder link 125.

For example, the first external unit elastic member retainer 1211 may be positioned over the second external unit elastic member retainer 1253, so when an external force is not applied to the external unit 12, the elasticity of the external unit elastic member 126 may act as a force that slides up the washing pad plate 127 with respect to the external unit housing 121 (a force that brings the external unit washing pad 128 in close contact with the glass w).

The elasticity of the external unit elastic member 126 may act as torque that rotates the blade holder 1222 in one direction (in the direction in which the blade 1224 comes in close contact with the glass w) through the external unit holder link 125 connected to the washing pad plate 127.

On the other hand, unlike those shown in the figures, it should be noted that the external unit elastic member 126 may be directly connected between the external unit housing 121 and the washing pad plate 127.

The external unit wheels 129 may enable the cleaning tool to be smoothly moved and may maintain the pressure applied to glass w from the front end of the blade 1224 at a predetermined level when a user cleans the glass w. A plurality of external unit wheels 129 may be disposed on the front surface of the external unit housing 121 and may protrude a predetermined height from the front surface of the external unit housing 121. A plurality of external unit wheels 129 may be disposed in the longitudinal direction and/or width direction of the internal unit housing 121, thereby being able to maintain the blade 1224 at a predetermined angle with respect to the glass w.

The operation structure according to an cleaning operation and a moving operation of the window cleaning tool 1 according to an embodiment is described with reference to FIGS. 4A to 11.

Figure 6:
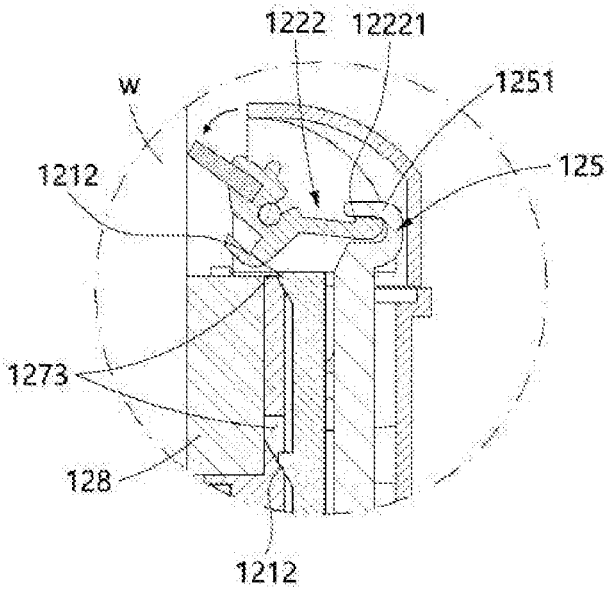
FIG. 6 is a cross-sectional view enlarging the portion A of the external unit shown in FIG. 5.
Figure 7:
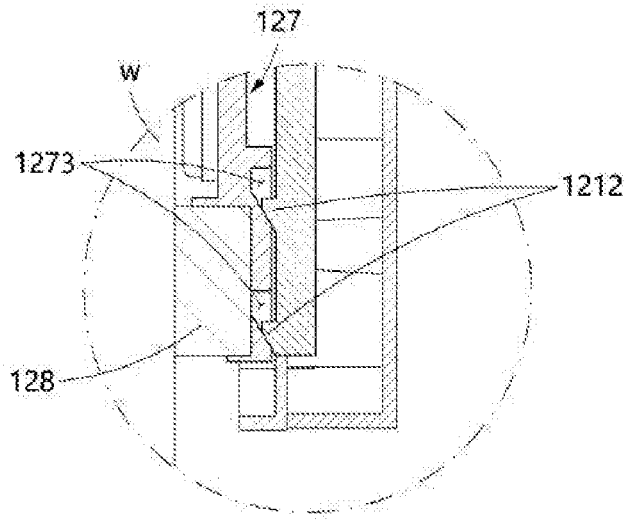
FIG. 7 is a cross-sectional view enlarging the portion B of the external unit shown in FIG. 5.

FIG. 4A is a rear view of the external unit according to an embodiment, FIG. 4B is an exploded perspective view of some parts of the external unit according to an embodiment, FIG. 5 is a lateral cross-sectional view when the window cleaning tool according to an embodiment of is moved down on a window, FIG. 6 is a cross-sectional view enlarging the portion A of the external unit shown in FIG. 5, and FIG. 7 is a cross-sectional view enlarging the portion B of the external unit shown in FIG. 5.

First, referring to FIGS. 5 to 7, it is possible to see the internal operation structure of the internal unit 11 and the external unit 12 in a "cleaning operation" in which the window cleaning tool 1 is moved down with respect to the glass w (toward the handle 113 on the internal unit 11) to clean the glass w.

As shown in FIG. 5, when a user performs the cleaning operation in which the user holds the handle 113 of the internal unit 11 and moves down the internal unit 11, the force applied to the handle 113 by the user may rotate the internal unit pivot lever 115 in one direction.

Accordingly, the internal unit holder link 118 connected to the internal unit pivot lever 115 moves up the first end of the blade holder 1122 of the internal unit wiper 112 and the blade 1124 disposed at the second end of the blade holder 1122 rotates toward the surface of the glass w, whereby the front end of the blade 1124 may be pressed in close contact with the surface of the glass w.

Accordingly, when the user holds the handle 113 and moves down the internal unit 11, the internal unit 11 may be moved down and the blade 1124 of the internal unit 11 may press the surface of the glass w and may be maintained in the state.

As described above, when a user moves down the internal unit 11 using the handle 113, a force may be applied down to the external magnet assemblies 123 by the attraction between the internal unit magnet assemblies 114 of the internal unit 11 and the external unit magnet assemblies 123 of the external unit 12.

Accordingly, the external unit magnet assemblies 123, as shown in FIG. 4A, may slide down with respect to the external unit housing 121. Further, the external unit pivot levers 124 connected to the external unit magnet assemblies 123 may rotate and move up the washing pad plate 127 and/or the external unit holder link 125 connected to the second ends of the external unit pivot levers 124.

Accordingly, the external unit holder link 125 moving up with respect to the external unit housing 121 moves up the first end of the blade holder 1222 of the external unit wiper 122 and the blade 1224 disposed at the second end of the blade holder 1222 rotates toward the surface of the glass w, whereby the front end of the blade 1224 may be pressed in close contact with the surface of the glass w.

The slope grooves 1273 of the washing pad plate 127 moving up with respect to the external unit housing 121 move away from the slope protrusions 1212 and the washing pad plate 127 is further protruded by interference of the slope protrusions 1212. Accordingly, the washing pad plate 127 moves up away from the external unit housing 121 (toward the glass w). Therefore, the external unit washing pad 128 may be pressed in close contact with the surface of the glass w.

According to this structure, when a user moves down the internal unit 11 with respect to the glass w, the washing pads 116 and 128 of the internal unit 1 and the external unit 12 attached to both sides of the glass w, respectively, are pressed to come in close contact with the glass w and the blades 1122 and 1222 rotate, whereby the blades 1124 and 1224 may come in close contact with the glass w.

Accordingly, in the cleaning process in which a user moves down the internal unit 11 using the handle 113, the washing pads 116 and 128 and the blades 1124 and 1222 of the internal unit 11 and the external unit 12 sequentially come in contact with both sides of the glass w, respectively. Accordingly, the user may wash both sides of the glass w and remove water through only one step.

Figure 8:
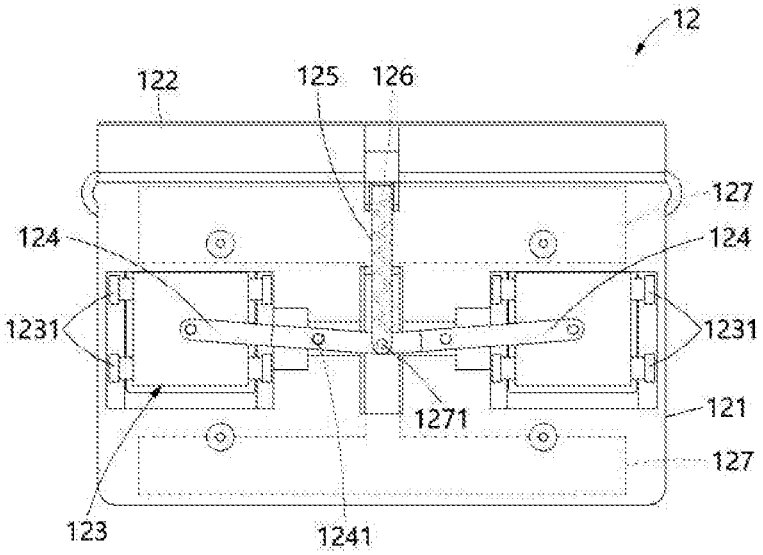
FIG. 8 is a rear view when the external unit according to an embodiment of the present disclosure is moved up on a window.
Figure 9:
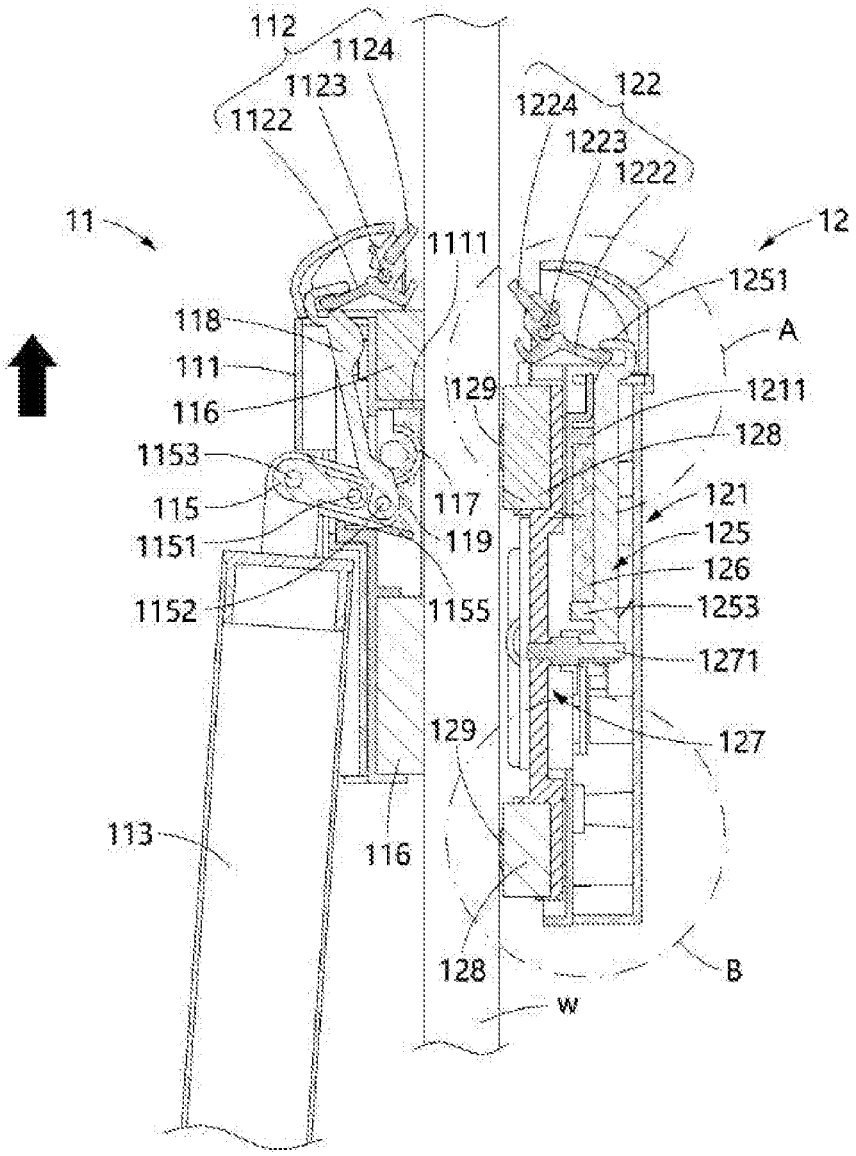
FIG. 9 is a lateral cross-sectional view when the window cleaning tool according to an embodiment of the present disclosure is moved up on a window.
Figure 10:
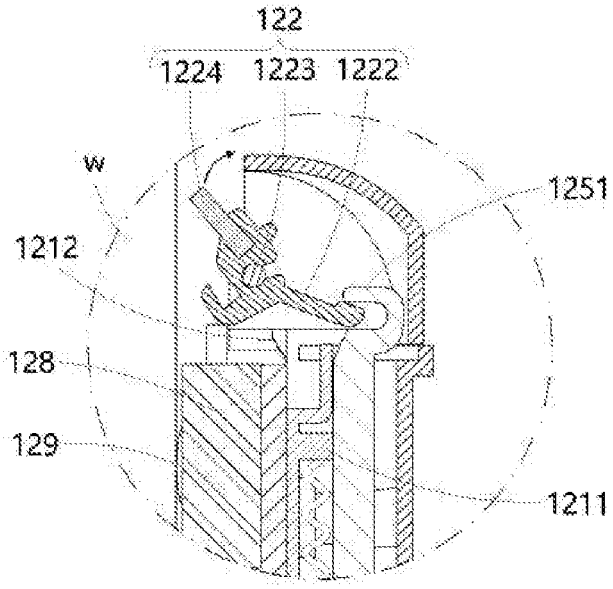
FIG. 10 is a cross-sectional view enlarging the portion A of the external unit shown in FIG. 9.
Figure 11:
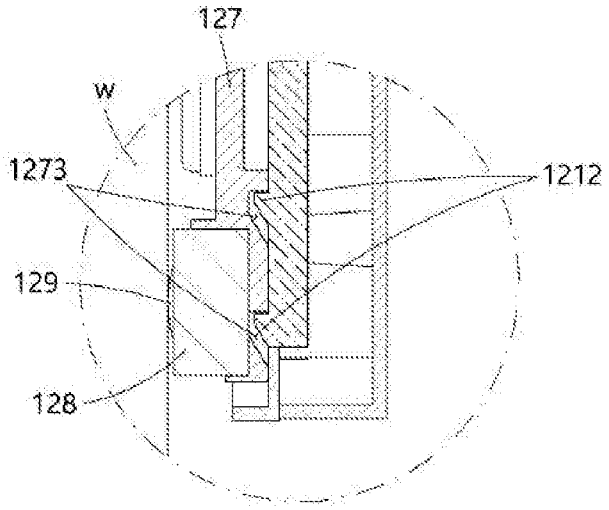
FIG. 11 is a cross-sectional view enlarging the portion B of the external unit shown in FIG. 9.

FIG. 8 is a rear view when the external unit according to an embodiment is moved up on a window, FIG. 9 is a lateral cross-sectional view when the window cleaning tool according to an embodiment of is moved up on a window, FIG. 10 is a cross-sectional view enlarging the portion A of the external unit shown in FIG. 9, and FIG. 11 is a cross-sectional view enlarging the portion B of the external unit shown in FIG. 9.

Referring to FIGS. 8 to 11, it is possible to see the internal operation structure of the internal unit 11 and the external unit 12 in the "moving operation" that moves up the window cleaning tool 1 with respect to the glass w (toward the blade 1124 of the internal unit 11).

As shown in FIG. 9, when a user performs the cleaning operation in which the user holds the handle 113 of the internal unit 11 and moves up the internal unit 11, the force applied to the handle 113 by the user may rotate the internal unit pivot lever 115 in the opposite direction (clockwise) to the rotation direction (counterclockwise) in the "cleaning operation".

Accordingly, the internal unit holder link 118 connected to the internal unit pivot lever 115 pulls down the first end of the blade holder 1122 of the internal unit wiper 112 and the blade 1124 disposed at the second end of the blade holder 1122 rotates away from the surface of the glass w, whereby the blade 1124 may be spaced from the surface of the glass w.

Accordingly, when the user holds the handle 113 and moves up the internal unit 11, the internal unit 11 may be moved up and the blade 1124 of the internal unit 11 may be spaced from the surface of the glass w and maintained in the state.

As described above, when a user moves up the internal unit 11 using the handle 113, a force may be applied upward to the external magnet assemblies 123 by the attraction between the internal unit magnet assemblies 114 of the internal unit 11 and the external unit magnet assemblies 123 of the external unit 12.

Accordingly, the external unit magnet assemblies 123, as shown in FIG. 8, may slide up with respect to the external unit housing 121. Further, the external unit pivot levers 124 connected to the external unit magnet assemblies 123 may rotate and move down the washing pad plate 127 and/or the external unit holder link 125 connected to the second ends of the external unit pivot levers 124.

Accordingly, the external unit holder link 125 moving down with respect to the external unit housing 121 pulls down the first end of the blade holder 1222 of the external unit wiper 122 and the blade 1224 disposed at the second end of the blade holder 1222 rotates away from the surface of the glass w, whereby the front end of the blade 1224 may be spaced from the surface of the glass w and maintained in the state.

The slope grooves 1273 of the washing pad plate 127 moving down with respect to the external unit housing 121 move to exactly fit to the slope protrusions 1212 and the interference between the washing pad plate 127 and the slope protrusions 1212 decreases. Accordingly, the washing pad plate 127 moves down toward the external unit housing 121 (away from the glass w). As a result, the external unit washing pad 128 may slightly come in contact with the surface of the glass w or may be spaced from the surface of the glass w and maintained in the state.

According to this structure, when a user moves up the internal unit 11 with respect to the glass w, the blades 1124 and 1224 of the internal unit 11 and the external unit 12 attached to both sides of the glass w may be spaced apart from the glass w and the external unit washing pad 128 of the external unit 12 may also be spaced apart from the glass w.

Accordingly, in the moving operation in which a user moves up the internal unit 11 using the handle 113, the blades 1124 and 1224 of the internal unit 11 and the external unit 12 are spaced apart from the glass 2, whereby it is possible to reduce friction that is generated when the window cleaning tool 11 is moved on the surface of the glass w.

As described above, since the friction between the glass w and the external unit 12 is additionally decreased by sparing the external washing pad on the washing pad plate 127 of the external unit 12 apart from the surface of the glass w, when the external unit 12 moves up while following the internal unit, synchronization with the internal unit (the rate of simultaneous moving-up of the internal unit and the external unit) increases, thereby being able to prevent the external unit from separating and falling.

Figure 12:
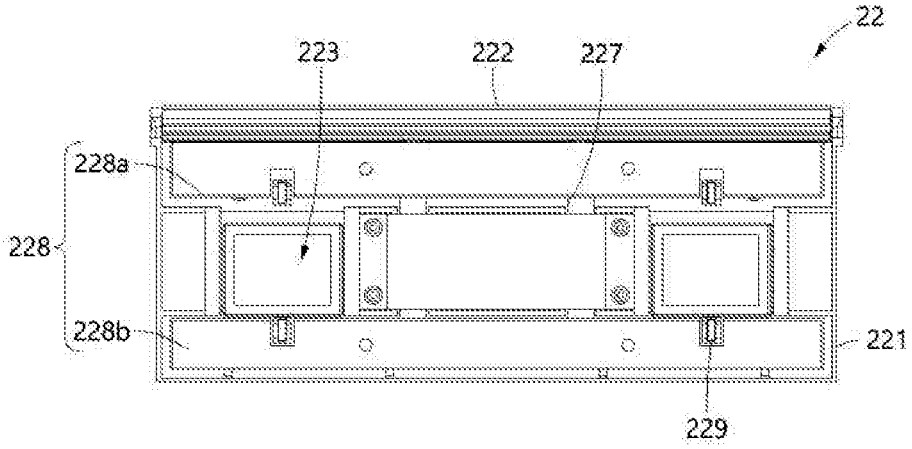
FIG. 12 is a front view of an external unit according to another embodiment of the present disclosure.
Figure 13:
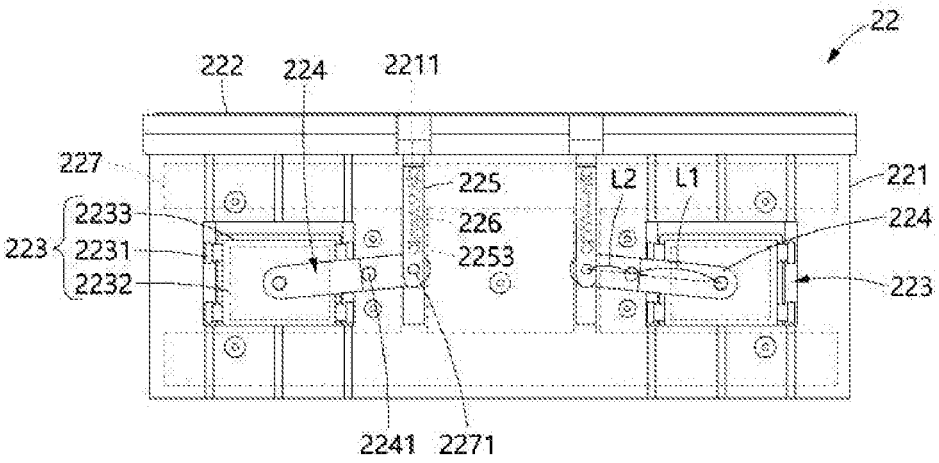
FIG. 13 is a rear view of the external unit according to another embodiment of the present disclosure.

FIG. 12 is a front view of an external unit according to another embodiment of the present disclosure and FIG. 13 is a rear view of the external unit according to another embodiment of the present disclosure.

Referring to FIGS. 12 and 13, it is possible to see the structure of an external unit 22 modified from the external unit 12 shown in FIGS. 1A to 11. A cleaner having a wide washing range is required to wash a window with a large area, so it is possible to use the external unit 22 in which some components are provided as two items at left and right sides in pairs, as shown in the figures.

The external unit 22 according to an embodiment may include an external unit housing 221, an external unit wiper 222, two external unit magnet assemblies 223, two external unit pivot levers 224, two external unit holder links 225, a washing pad plate 227, an external unit washing pad 228, two external unit elastic members 226, and external unit wheels 229.

The two external unit pivot levers 224, as shown in the figures, may respectively connect the two external unit magnet assemblies 223 and the two external unit holder links 225.

The two external unit holder links 225 each may have two external unit elastic member retainers, and the two external unit elastic members 226 may be connected between two first external unit elastic member retainers 2211 and two second external unit elastic member retainers 2253 of the external unit housing 221.

According to this structure, as compared with the case in which the external unit wiper is rotated using only one external unit holder link, it is possible to more stably and reliably transmit torque, so this structure may be applied to an external unit wiper with a large width.

Figure 14A:
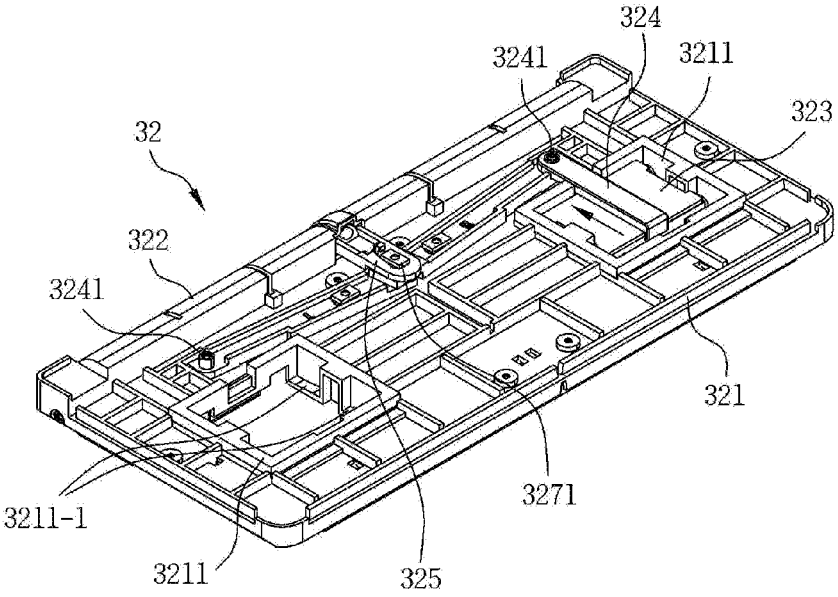
FIGS. 14A and 14B are rear views when an external unit according to another embodiment of the present disclosure is moved up and down.
Figure 14B:
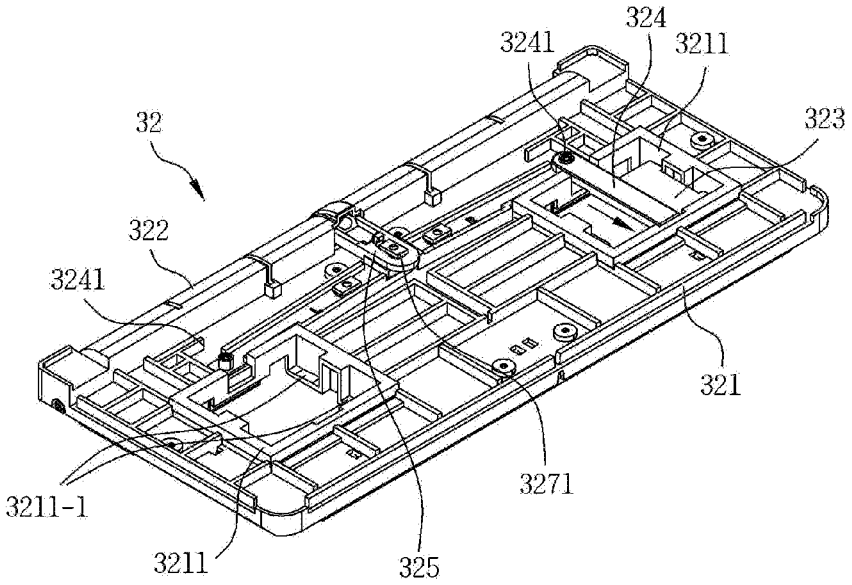
Figure 15A:
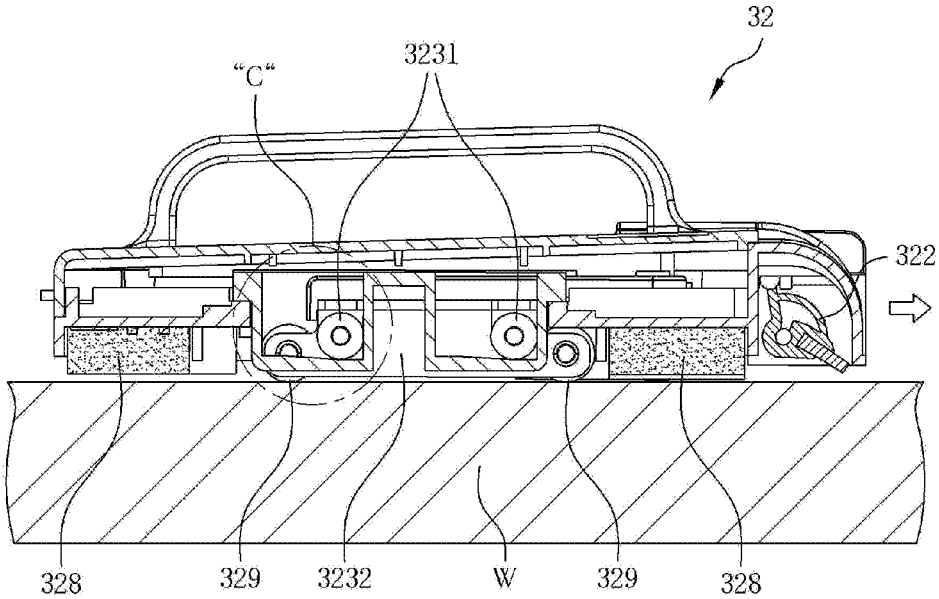
FIGS. 15A and 15B are lateral cross-sectional views of FIGS. 14A and 14B, respectively.
Figure 15B:
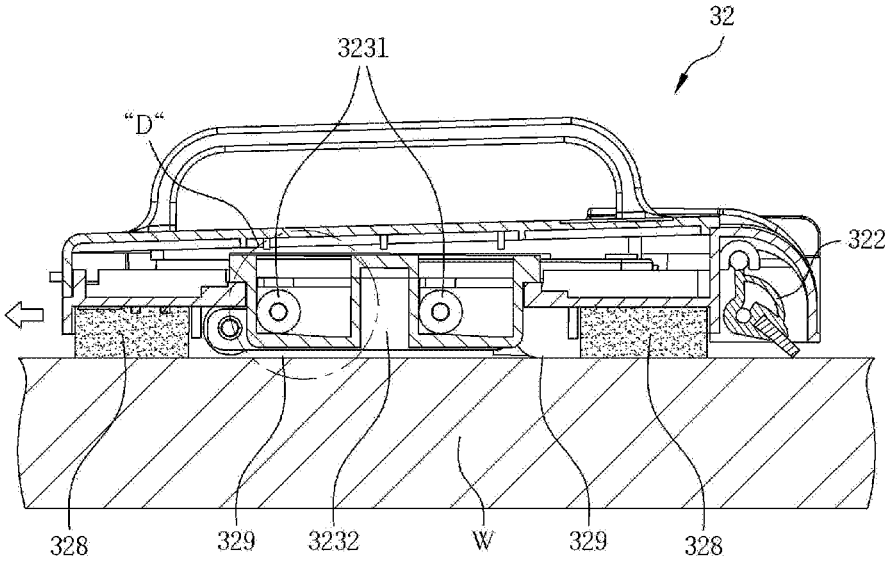
Figure 15C:
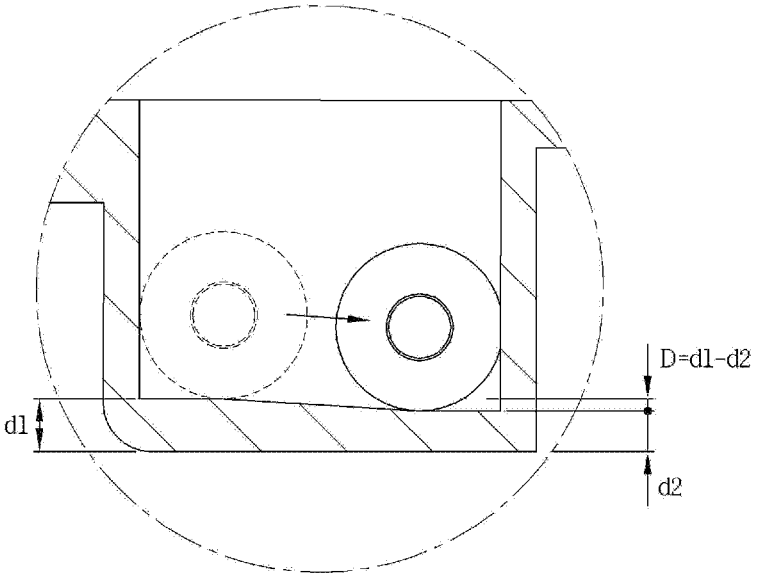
FIGS. 15C and 15D are enlarged views of a portion C of FIG. 15A and a portion D of FIG. 15B.
Figure 15D:
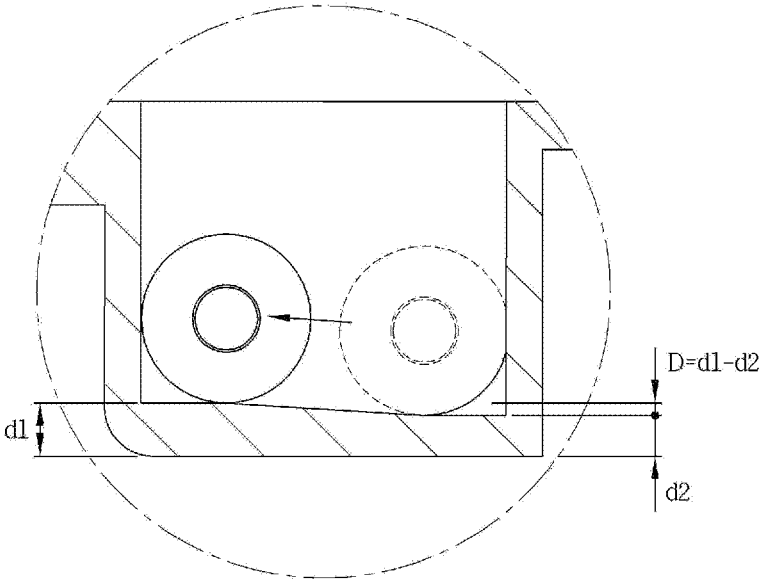
Figure 16:
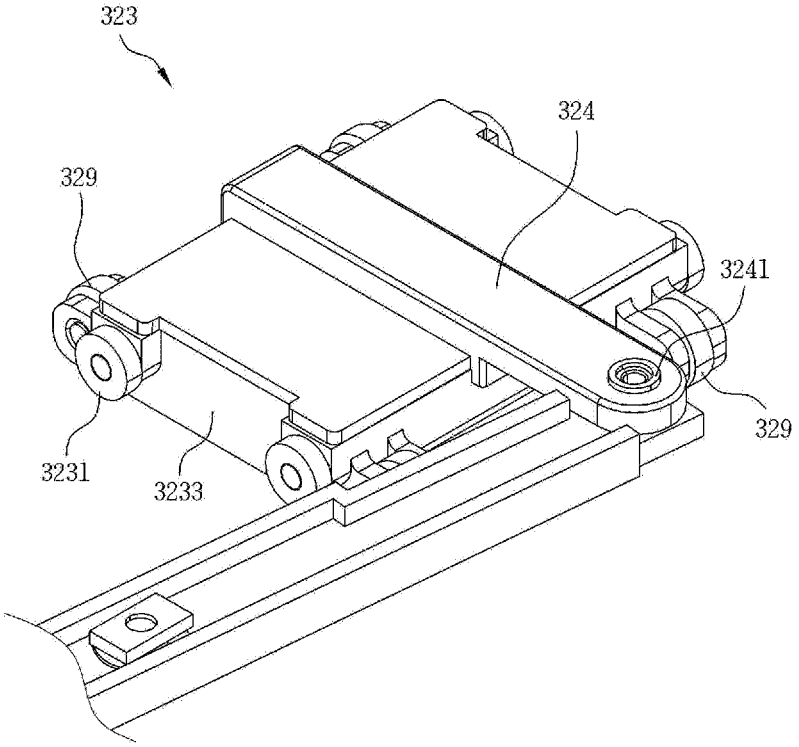
FIG. 16 is a perspective view of a magnet assembly according to another embodiment of the present disclosure.

FIGS. 14A and 14B are rear views when an external unit according to another embodiment of the present disclosure is moved up and down, FIGS. 15A and 15B are lateral cross-sectional views of FIGS. 14A and 14B, respectively, FIGS. 15C and 15D are enlarged views of a portion C of FIG. 15A and a portion D of FIG. 15B, and FIG. 16 is a perspective view of a magnet assembly according to another embodiment of the present disclosure.

Referring to FIGS. 14A and 14B, it is possible to see the structure of an external unit 32 modified from the external unit 12 shown in FIGS. 1A to 11. It is possible to use the external unit 32 that enables easy manufacturing of a mold for the external unit, enables reduction of the number of parts without parts such as the washing pad plate 127 according to the first embodiment (see FIG. 4B), and has a magnet assembly 323 of which the structure is modified to reduce the weight of the entire external unit.

The external unit 32 according to another embodiment of the present disclosure may include an external unit housing 321, an external unit wiper 322, external unit magnet assemblies 323 having four lower guide rollers 329 that are external unit wheels, two external unit pivot levers 324 facing each other in an L-shape or an inverse L-shape, an external unit holder link 325, and an external unit washing pad 328.

As described above, the washing pad plate 127 (see FIG. 4B) according to the first embodiment is removed, so it is possible to reduce the number of parts and the weight of the entire external unit and only the differences from the first embodiment are described.

First, as shown in FIG. 16, the external unit magnet assembly 323 may include a casing 3233, a magnet 3232 (see FIGS. 15A and 15B) disposed in the casing 3233, upper guide rollers 3231, and lower guide rollers 329 that are external unit wheels.

That is, the external unit magnet assembly 323 includes a magnet 3232 generating attraction with the internal magnet assembly 114 (see FIG. 1A, etc.), a casing 3233 for accommodating the magnet 3232, upper guide rollers 3231 disposed on both sides of the casing 3233, and lower guide rollers 329 formed at lower corners of the casing 3233 and functioning as external unit wheels that come in contact with the glass w.

The external unit housing 321 further includes guide rail housings 3211 each having guide rails 3211-1 inclined to provide paths for rolling the upper guide rollers 3231.

A total of four upper guide rollers 3231 are formed at the ends of both sides facing each other of the casing 3233, and two guide rails 3211-1 are inclined up and down and formed up and down on each of both sides facing each other at the lower portion in the guide rail housing 3211 having a substantially rectangular shape to enable the four upper guide rollers 3231 to roll.

The inclination decreases as it goes up.

Four lower guide rollers 329 protruding outward are disposed at the lower corners of both opposite sides perpendicular to both sides on which the four upper guide rollers 3231 are disposed of the casing 3233 having a substantially rectangular shape.

Unlike the "-"-shaped external unit pivot lever 124 having a first end rotatably connected to the shaft formed at the external unit magnet assembly 123 in the first embodiment, the external unit pivot lever 324 has an L-shaped or an inverse L-shaped structure in which a first end thereof may be integrally coupled to the casing 3233 and rotatably disposed on the external unit housing 321 by a pivot shaft 3241 formed substantially at the center and a second end thereof may be rotatably connected to the external unit holder link 325 through a connection joint 3271. The substantial rotation of the external unit pivot lever 124 is the same as that of the external unit pivot lever 124 having the "-"-shape according to the first embodiment, so additional description is not provided.

As described above, the operation by the structure in which the external unit magnet assembly 323 includes the upper guide rollers 3231 and the lower guide rollers 329 that are external unit wheels and the external unit housing 321 includes the guide rail housings 3211 having the guide rails 3211-1 inclined to provide paths for rolling the upper guide rollers 3231 is described hereafter.

As shown in FIGS. 14A, 15A, and 15C, when the external unit magnet assembly 323 of the external unit 32 moves up while following the internal unit, the magnet 323 moves up along the guide rails of the guide rail housing 3211 of the external unit housing 321. In this process, the four lower guide rollers 329 formed at the lower corners of the magnet casing 3233 move up in contact with a glass surface and the four upper guide rollers 3231 at both sides of the casing 3233 moves up along the guide rails 3211-1 that are inclined downward as they go up. That is, the upper guide rollers 3231 moves from the high inclined points at the lower portions of the guide rails 3211-1 (the height from the glass surface to the guide rail is d1 at the points) to the low inclined points at the upper portions (the height from the glass surface to the guide rail is d2 at the points). Accordingly, spaces (D=d1-d2) are formed between the outer surfaces of the upper guide rollers 3231 and the surfaces of the guide rails 322-1 and the washing pad attached to the front surface of the external unit is moved away from the surface of the glass w as much as the distance of the spaces, whereby the friction between the glass w and the washing pad 328 decreases. Accordingly, the external unit 32 may smoothly move up while following the internal unit and synchronization with the internal unit (the rate of simultaneous moving-up) increases, thereby being able to prevent the external unit from separating an falling.

As shown in FIGS. 14A, 15B, and 15D, when the external unit magnet assembly 323 of the external unit 32 moves down while following the internal unit, the magnet 323 moves down along the guide rails of the guide rail housing 3211 of the external unit housing 321. In this process, the four lower guide rollers 329 formed at the lower corners of the magnet casing 3233 move down in contact with a glass surface and the four upper guide rollers 3231 at both sides of the casing 3233 moves down along the guide rails 3211-1 that are inclined upward as they go down. That is, the upper guide rollers 3231 move from the low inclined points (height: d2) at the upper portions of the guide rails 3211-1 to the high inclined points (height: d1) at the lower portions. In this process, the upper guide rollers 3231 press the surfaces of the guide rails 3211-1 toward the glass surface as much as the inclination difference D of the guide rails 3211-1, so the washing pad attached to the front surface of the external unit comes in close contact with the surface of the glass w and the friction between the glass w and the washing pad 328 increases. Accordingly, when the external unit 32 moves down while following the internal unit, the washing pad 328 and the external unit wiper 322 may easily wash the surface of the glass and remove water.

Figure 17A:
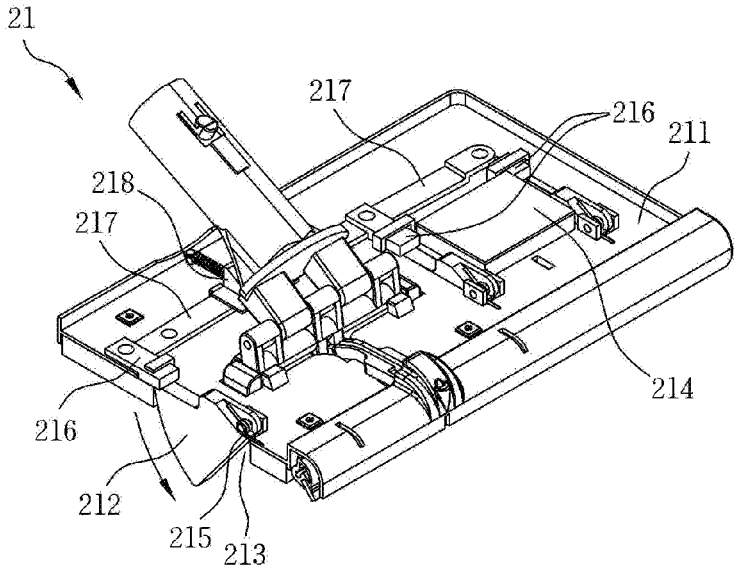
FIG. 17A is a perspective view showing the using state of an internal unit having safety plates according to another embodiment of the present disclosure.
Figure 17B:
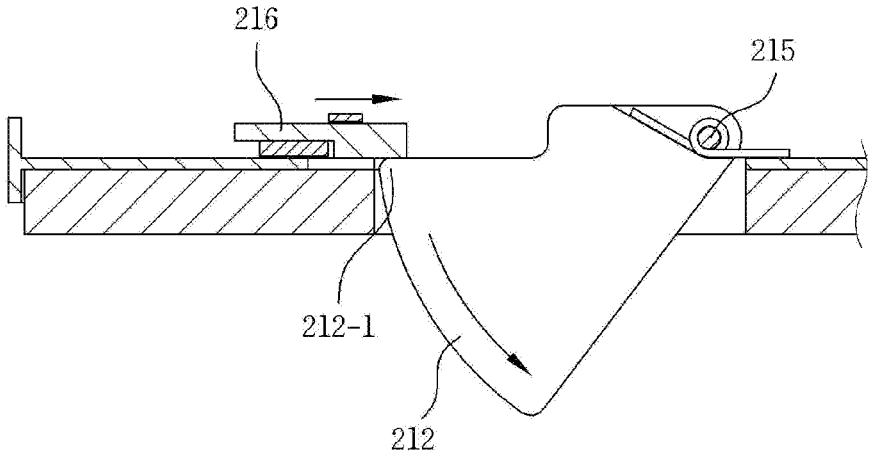
FIG. 17B is a cross-sectional view showing the using state of the safety plates of FIG. 17A.
Figure 18:
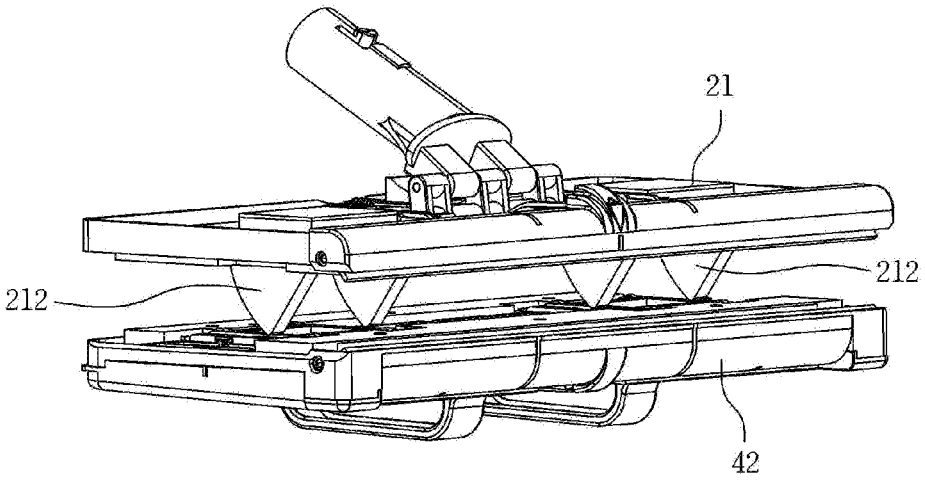
FIG. 18 is a perspective view of the internal and external units which shows the function of the safety plates of the internal unit having safety plates according to another embodiment of the present disclosure.
Figure 19A:
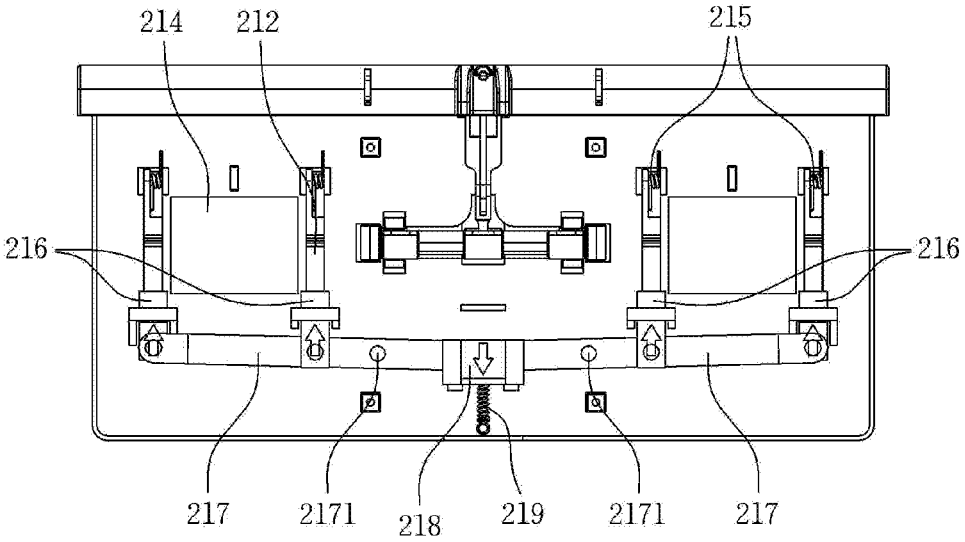
FIG. 19A is a plan view showing the operation state of a stopper lever mechanism when the stopper levers are locked to the safety plates of the internal unit of FIG. 17A.
Figure 19B:
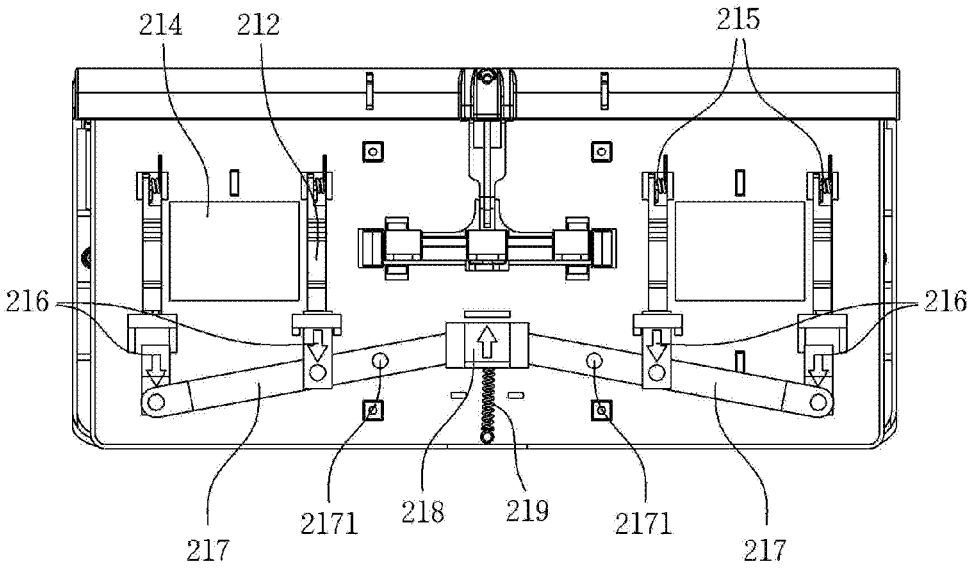
FIG. 19B is a plan view showing the operation state of the stopper lever mechanism when the internal unit of FIG. 17A is attached to glass.
Figure 20A:
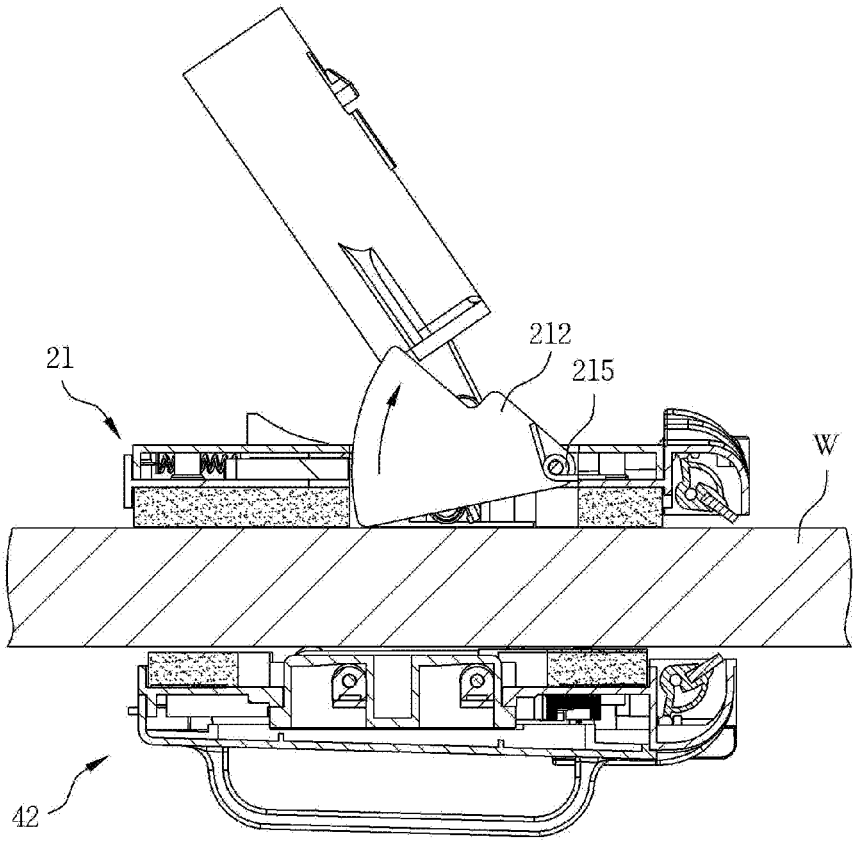
FIGS. 20A and 20B are perspective views of internal and external units which show the operation state of the safety plates when performing washing with the internal unit having safety plates of FIG. 17A.
Figure 20B:
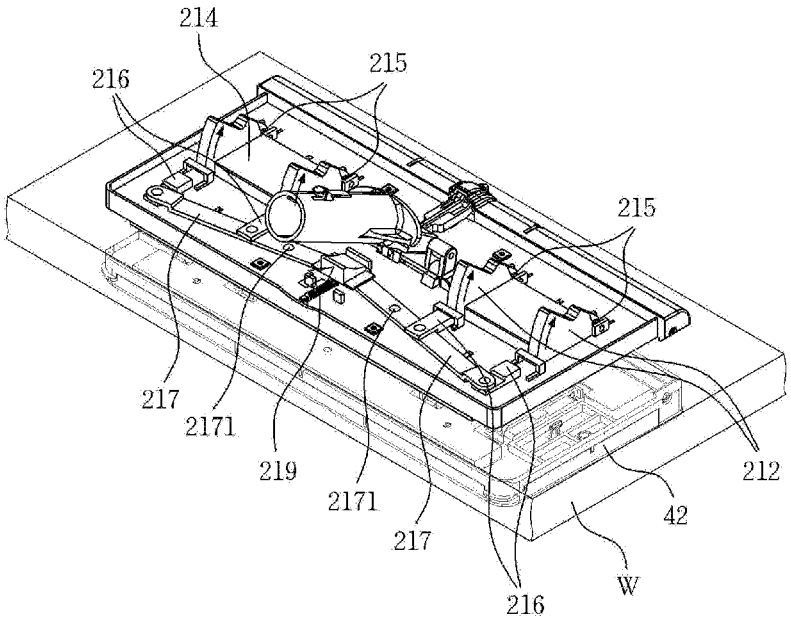

FIG. 17A is a perspective view showing the using state of an internal unit having safety plates according to another embodiment of the present disclosure, FIG. 17B is a cross-sectional view showing the using state of the safety plates of FIG. 17A, FIG. 18 is a perspective view of the internal and external units which shows the function of the safety plates of the internal unit having safety plates according to another embodiment of the present disclosure, FIG. 19A is a plan view showing the operation state of a stopper lever mechanism when the stopper levers are locked to the safety plates of the internal unit of FIG. 17A, FIG. 19B is a plan view showing the operation state of the stopper lever mechanism when the internal unit of FIG. 17A is attached to glass, and FIGS. 20A and 20B are perspective views of internal and external units which show the operation state of the safety plates when performing washing with the internal unit having safety plates of FIG. 17A.

Referring to FIGS. 17A and 18, it is possible to see the structure of an internal unit 21 modified from the internal unit 11 shown in FIGS. 1A to 11.

That is, in this embodiment, since the magnetic attraction between the internal unit and the external unit is so strong, if the internal unit and the external unit facing each other are positioned close to each other while a user handles the window cleaning tool, the internal unit and the external unit may stick to each other in an instant, and in this case, the user's body may be injured or the cleaning tool may be broken. Accordingly, it is possible to use the internal unit 21 of which the structure is modified to further include safety plates 212 that protrude from the internal unit housing toward the rear surface of the external housing when the cleaner is handled except that it is used. The direction going to the front surface may be the direction going to glass w from the internal and external units (or the safety plate) and the direction going to the rear surface may be the direction going away from the glass from the internal and external units (or the safety plate).

The internal unit 21 according to another embodiment of the present disclosure may include an internal unit housing 211, two internal unit magnet assemblies 214, safety plates 212, a safety plate guide hole 213, a torsion spring 215, and a stopper lever mechanism composed of stoppers 216, stopper levers 217, a stopper knob for gripping 218, and a stopper knob elastic member 219.

As shown in FIGS. 17A and 18, the internal unit 21 according to another embodiment of the present disclosure further includes safety plates 212 that protrude from the internal unit housing 211 toward the rear surface of the external unit at both left and right sides of two internal unit magnet assemblies 214.

Although the shape of the safety plates 212 is not limited, the safety plates 212 may have a substantially ⅛ arc shape and are not limited thereto.

The safety plates 212 are disposed at both left and right sides of each of two internal unit magnet assemblies 214, so a total of four safety plates are provided in the embodiment shown in the figures, but they may be formed at any one of both left and right sides of each of the two internal unit magnet assemblies 214.

The internal unit 21 according to another embodiment of the present disclosure, as shown in FIG. 17A, etc., further includes a plurality of safety plat guide holes 213 elongated up and down in the internal unit housing 211 to guide forward/rearward the safety plates 212, and a plurality of torsion springs 215 formed over the safety plate guide holes 213 to apply a force that protrudes the safety plates 212 toward the rear surface of the external unit 42.

The internal unit 21 according to another embodiment of the present disclosure, as shown in FIGS. 19A and 19B, further includes a stopper lever mechanism configured to rotate up and down to prevent and enable rearward protrusion of the safety plates 212. The stopper lever mechanism includes: stoppers 216 disposed under the safety plate guide holes 213, being movable up and down to partially covers the lower portions of the safety guide holes 213, and preventing the safety plates 212 from protruding rearward; a pair of left and right symmetric stopper levers 217 having first ends connected to the stoppers 216, rotatably disposed on the internal unit housing 211 by lever shafts 2171, and being able to move up and down such that the stoppers 216 prevent and enable rearward protrusion of the safety plates 212; a stopper knob for gripping 218 disposed between the stopper levers 217 and connected to second ends of the stopper levers 217 to transmit up and down rotational force of the stopper levers 217; and a stopper knob elastic member 219 elastically supporting the stopper knob for gripping 218.

Since the internal unit 21 includes the safety plates 21, as described above, when the window cleaning tool including the internal unit 21 and the external unit 42 is not used, as shown in FIGS. 17A and 18, the safety plates 212 are protruded toward the rear surface of the external unit 42 by the torsion spring 215 and rearward movement of the safety plates 216 is stopped by the stoppers 216, whereby the internal unit 21 and the external unit 42 are prevented from sticking to each other due to magnetism. Accordingly, it is possible to prevent injuries to the user's body and breakdown of the cleaning tool.

In actual work, as shown in FIGS. 19B and 20B, since the internal unit 21 includes the stopper lever mechanism, when a user moves up the stopper knob for gripping 218 (in the direction of an arrow), the left and right symmetric stopper levers 217 are rotated by the lever shafts 2171 and the stoppers 216 are moved down, so the safety plates 212 may rotate rearward (away from the glass surface). In this state, when the internal unit 21 is brought in close contact with the surface of the glass w, the safety plates 212 are naturally rotated rearward, the internal unit and the external unit are brought in close contact with each other and maintained in this state by the magnetic attraction, and cleaning is performed in this state.

When the internal and external units are taken off the glass surface after cleaning, as shown in FIG. 17B, the safety plates 212 of the internal unit 21 are rotated to protrude forward from the internal unit by the force of the torsion spring 215. In this process, the rear ends 212-1 of the safety plates are moved under the stoppers 216 and the stoppers 216 are moved up by the force of the stopper knob elastic member 219 pulling down the stopper levers 217 and lock the rear portions of the safety plates 212, whereby the safety plates 212 are locked with the forward protrusive portions protruded toward the external unit (see FIG. 17A). Accordingly, even if the internal and external units move close to each other and stick to each other due to carelessness while the cleaner is handled, the attraction is decreased by the forward protrusion distance of the safety plates 212, whereby it is possible to prevent strong sticking of magnets (see FIG. 18).

Accordingly, it would be understood that the present disclosure is not limited to the configurations proposed in the specification. Therefore, the technical protective region of the present disclosure should be determined by the scope described in claims. Further, it should be understood that the present disclosure includes the spirit of the present disclosure defined by claims and all modifications, equivalents, and replacements within the spirit.

What is claimed is:

1. A window cleaning tool comprising:

an internal unit comprising an internal unit housing, an internal unit blade holder disposed rotatably with respect to the internal unit housing, an internal unit wiper having an internal unit blade fixed to the internal unit blade holder and protruding toward an inner surface of glass, and a total of two internal unit magnet assemblies respectively disposed at both sides of the internal unit housing; and an external unit comprising an external housing, an external unit blade holder disposed rotatably with respect to the external unit housing, an external unit wiper having an external unit blade fixed to the external unit blade holder and protruding toward an outer surface of glass, and a total of two external unit magnet assemblies respectively disposed at both sides of the external unit housing and applying attraction between the internal unit magnetic assemblies and the external unit magnetic assemblies, wherein when the internal unit moves up, a front end of the internal unit blade rotates away from the inner surface of the glass and a front end of the external unit blade rotates away from an outer surface of the glass, and when the internal unit moves down, the front ends of the internal unit blade and the external unit blade rotate toward the surface of the glass to be pressed, wherein the external unit magnetic assemblies each comprise:

a magnet generating attraction between the internal unit magnetic assembly and the magnet;

a casing accommodating the magnet;

upper guide rollers disposed on both sides of the casing; and lower guide rollers formed at lower corners of the casing and coming in contact with the glass, and the external unit housing comprises guide rails having an inclined portion, the guide rails providing paths enabling the upper guide rollers to roll through the inclined portion up and down.

2. The window cleaning tool of claim 1, wherein the external unit housing further comprises rectangular guide rail housings in which the guide rails are formed on both sides facing each other at a lower portion.

3. The window cleaning tool of claim 2, wherein the guide rollers comprise a total of four upper guide rollers which are formed at ends of both facing sides of the casing, and the guide rails comprise two guide rails which are each inclined up or down on both sides of the external unit housing at the lower portion in the rectangular guide rail housing.

4. The window cleaning tool of claim 3, wherein the inclination of the guide rails decreases as it goes up.

5. The window cleaning tool of claim 3, wherein the lower guide rollers comprise four lower guide rollers protrude outward at the lower corners of the casing.

6. The window cleaning tool of claim 1, wherein the internal unit further comprises:

a handle configured to be held by a user;

an internal unit holder link pushing or pulling an end of the internal blade holder such that the front end of the internal unit blade is pressed to the inner surface of the glass or is spaced from the inner surface of the glass; and an internal unit pivot lever having a pivot shaft rotatably connected to the internal unit housing, a handle shaft rotatably connected to the handle, and a link shaft rotatably connected to the internal holder link.

7. The window cleaning tool of claim 6, wherein the internal unit further comprises an internal unit elastic member connected between the internal unit housing and the internal unit pivot lever, providing elasticity pressing the front end of the internal unit blade to the inner surface of the glass, and helping downward movement of the handle with respect to the internal unit housing.

8. The window cleaning tool of claim 1, wherein the internal unit further comprises a plurality of safety plates protruding toward a rear surface of the external unit from the internal unit housing at a side or both sides of the internal unit magnetic assemblies.

9. The window cleaning tool of claim 8, wherein the internal unit further comprises: a plurality of safety plate guide holes elongated up and down in the internal housing to guide the plurality of safety plates forward and rearward; and a plurality of torsion springs disposed over the plurality of safety plate guide holes and applying a force protruding the plurality of safety plates toward the rear surface of the external unit.

10. The window cleaning too of claim 8, wherein the internal unit further comprises a stopper lever mechanism configured to rotate up and down to prevent and enable rearward protrusion of the plurality of safety plates, and the stopper lever mechanism comprises:

stoppers formed to be able to move up and down under the plurality of safety plate guide holes and preventing and enabling rearward protrusion of the plurality of safety plates;

a pair of left and right symmetric stopper levers each having a first end connected to the stoppers, disposed on the internal unit housing to be rotatable by lever shafts, and being able to move up and down such that the stoppers prevent and enable rearward protrusion of the safety plates;

a stopper knob for gripping disposed between the stopper levers to transmit up and down rotational force of the stopper levers; and a stopper knob elastic member elastically supporting the stopper knob for gripping.

* * * * *